US005722367A

United States Patent [19]

Izydorek et al.

[11] Patent Number: 5,722,367

[45] Date of Patent: Mar. 3, 1998

[54] INGINE IDLE SPEED AIR CONTROL

[75] Inventors: Randall P. Izydorek, Snover; Charles H. Tuckey, Cass City; Kevin L. Williams, Columbiaville, all of Mich.

[73] Assignee: Walbro Corporation, Cass City, Mich.

[21] Appl. No.: 654,541

[22] Filed: May 29, 1996

Related U.S. Application Data

[63] Continuation-in-part of Ser. No. 541,640, Oct. 10, 1995, abandoned, and Ser. No. 607,228, Feb. 26, 1996, abandoned.

[51] Int. Cl.[6] ..... F02M 3/09

[52] U.S. Cl. ..... 123/339.13; 123/339.28; 251/30.03

[58] Field of Search ..... 123/339.13, 339.27, 123/339.28, 339.23, 587; 251/30.03, 30.04; 137/907

[56] References Cited

U.S. PATENT DOCUMENTS

| | | | |
|---|---|---|---|
| 3,943,975 | 3/1976 | Schmittker | 251/30.03 |
| 4,355,606 | 10/1982 | Casey | 251/30.03 |
| 4,823,750 | 4/1989 | Niida et al. | 123/339 |
| 5,012,789 | 5/1991 | Spicuzza et al. | 123/587 |
| 5,188,073 | 2/1993 | Ejiri et al. | 123/339.28 |
| 5,325,830 | 7/1994 | Hammer | 123/339.27 |

*Primary Examiner*—Andrew M. Dolinar
*Attorney, Agent, or Firm*—Barnes, Kisselle, Raisch, Choate, Whittemore & Hulbert

[57] ABSTRACT

A control device for bypassing intake air around a closed throttle valve of an operating engine while it is idling. The device has a main flow control valve controlling bypass air flow in the bypass air passageway of the device and movable to closed and open positions by a diaphragm actuated by engine intake vacuum controlled by a pilot valve actuated by a solenoid. The main valve, pilot valve and plunger of the solenoid are all movably received on and supported by a stationary slide rod which preferably extends into the coil of the solenoid and is supported adjacent only one end in a cantilever fashion. The main valve includes a main valve body with piston head movable with a flow clearance in and out of an air passage bore of the air outlet side of the bypass air passageway. An annular main valve seat is located at the open upstream end of the bore through which the piston head moves in its axial travel between fully open and closed positions of the main valve. The main valve also includes a flexible valve disc upstream of the valve body which is engageable with the main valve seat to fully close the same. The valve disc is controllably peeled off the main valve seat by a wedge shaped face of the piston head during initial opening travel of the main valve. The piston is also peripherally shaped to cooperate with the air passage bore and main valve seat to controllable vary the flow controlling cross sectional area of the bypass passageway and hence the bypass air flow rate as a function of incremental axial travel of the main valve along the slide rod.

67 Claims, 11 Drawing Sheets

INGINE IDLE SPEED AIR CONTROL

CO-PENDENCY APPLICATIONS

This application is a continuation-in-part of U.S. application Ser. No. 08/541,640, filed Oct. 10, 1995, now abandoned, and U.S. application Ser. No. 08/607,228 filed Feb. 26, 1996, now abandoned.

FIELD OF THE INVENTION

This invention relates to controlling the idle speed of an automotive vehicle engine and more particularly to a throttle valve bypass air control.

BACKGROUND OF THE INVENTION

In vehicle engines, the idle speed changes in response to changes in operating conditions such as engine cooling water temperature, load on the alternator, operation of the air conditioning compressor, ambient air temperature, humidity and pressure, etc. A substantially constant engine speed at idle with the throttle valve closed can be maintained under these varying conditions by varying the quantity of air in response to changing conditions which bypasses the closed throttle valve and enters the engine while idling.

U.S. Pat. No. 4,823,750 issued on Apr. 25, 1989 discloses a vehicle engine idle speed control with a diaphragm actuating a valve controlling the quantity of air bypassing the closed throttle valve and entering the engine. For controlling the valve, the diaphragm communicates with the engine intake manifold downstream of the throttle valve to provide a vacuum source through a valve stem having a central communication and control passage. The valve stem is slidably received and supported at one end in a bore in a casing having a variable orifice therein communicating with the manifold vacuum source to control the opening and closing of the valve by movement of a closure by a solenoid which is engageable with the control passage at the other end of the valve stem.

OBJECTS OF THE INVENTION

Objects, features and advantages of this invention include the provision of an engine idle speed air flow control device generally of the type disclosed in the aforementioned U.S. Pat. No. 4,823,750 but improved thereover in providing an air flow rate which is highly repeatable, reliably proportional to an electric current actuating the solenoid of the pilot valve and diaphragm assembly, has a wide range of air flow rates, a high maximum flow rate with a relatively compact valve and housing assembly, minimizes surges in the intake air to provide a smooth, reliable and repeatable control of bypass idle air flow, can be adapted for forward and reverse flow manifolds, is relatively easy and economical to manufacture and assemble, and in service is rugged, reliable, durable and has a relatively long useful life.

SUMMARY OF THE INVENTION

In general, and by way of summary description and not by way of limitation, the foregoing objects are achieved by providing an improved engine idle speed air control device with a main flow valve, a pilot valve and a solenoid plunger controlling the pilot valve, all of which are slidably received and supported on a stationary shaft. Preferably, the shaft is mounted adjacent only one end in a cantilever fashion in a housing and extends at its free end through an annular main valve seat and into a passage bore of the housing air outlet passageway. The main valve is preferably a subassembly of a valve body slidable interiorly and exteriorly of the passage bore past the main valve seat, and a flexible valve disc movable with the valve body exteriorly of the bore passage for opening and closing flow therethrough. The main valve is actuated by a diaphragm controlled by the pilot valve. Preferably air entering the diaphragm chamber passes through a filter carried by the flow valve and movable therewith. Preferably the pilot valve assembly has a seat carried by the main valve and a closure carried by the solenoid plunger.

In one embodiment, the solenoid, shaft, and valve assembly are coaxial with the outlet passageway of the housing. Preferably, the housing is constructed such that it can be rotated to position the outlet passageway, and hence, the solenoid, shaft and valve assembly, downstream from the throttle valve while the inlet passageway is upstream of the throttle valve regardless of the direction of intake air flow. This allows use of the engine idle speed air control device with both forward and reverse flow air intake manifolds.

BRIEF DESCRIPTION OF THE DRAWINGS

The foregoing as well as other objects, features and advantages of this invention will be apparent from the following detailed description of the preferred embodiments and best mode, appended claims, and accompanying drawings (which are to engineering scale unless otherwise indicated) in which:

DETAILED DESCRIPTION OF PREFERRED EMBODIMENTS

First Embodiment

Figure 1:
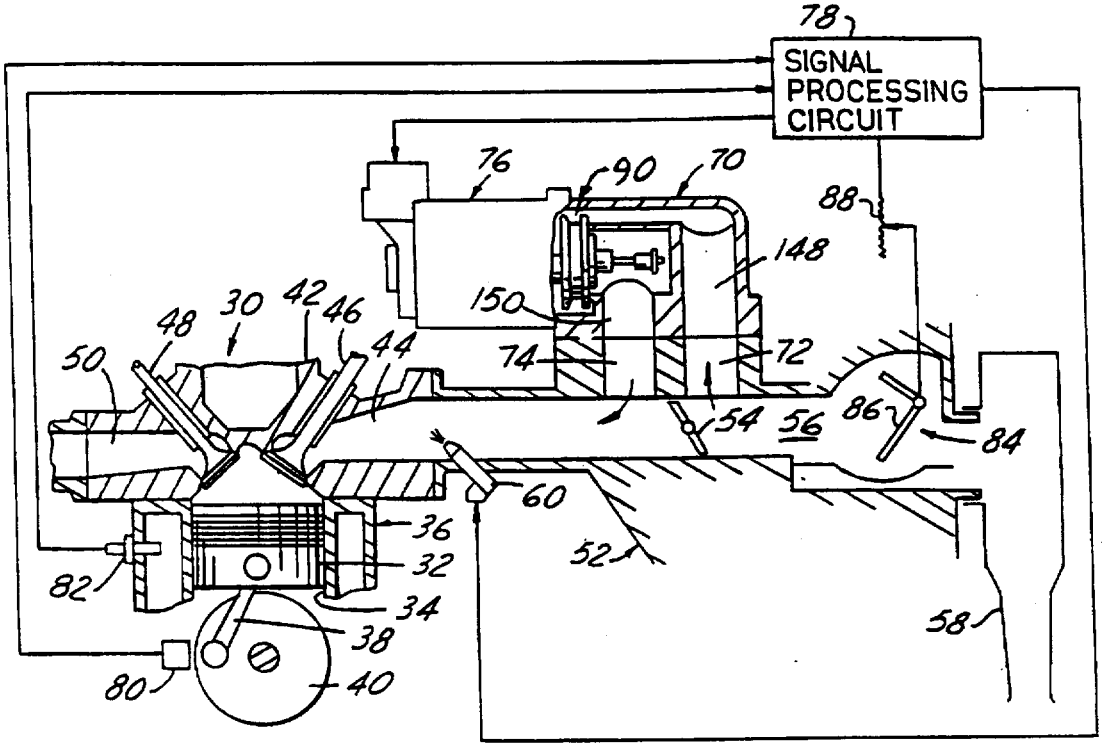
FIG. 1 is a diagrammatic illustration of a first embodiment of an idle air speed control device of the invention shown in conjunction with an engine air intake throttle manifold and control circuit.

FIG. 1 illustrates an internal combustion engine 30 with pistons 32 each received in a cylinder 34 of an engine block 36 and connected by a rod 38 to a crankshaft 40. A cylinder head 42 mounted on the block has an intake passage 44 with an intake valve 46 and an exhaust valve 48 and passage 50 associated with each cylinder. To support combustion, atmospheric air is supplied to the intake passage for each cylinder through an air intake manifold 52 with an air flow throttle control valve 54 in an intake passage 56 which communicates with the atmosphere through an air filter 58 or cleaner. Immediately adjacent each intake passage 44, a fuel injector 60 discharges fuel into the air stream which enters an associated cylinder 36 when its intake valve 46 is open.

An air control bypass valve device 70 of a first embodiment of this invention is mounted on the air intake manifold 52 in communication with a bypass air intake passage 72 upstream of the throttle valve and a bypass air discharge or vacuum manifold passage 74 downstream of the throttle valve. The bypass device 70 has a solenoid 76 which is actuated and controlled by a central processing unit 78 (CPU) of the engine which receives inputs from a crankshaft engine speed sensor 80, a water temperature sensor 82, and an intake air flow rate sensor 84 in the form of a vane 86 pivotally mounted in the intake manifold passage upstream of the throttle valve and connected with a variable resistor 88.

Figure 2:
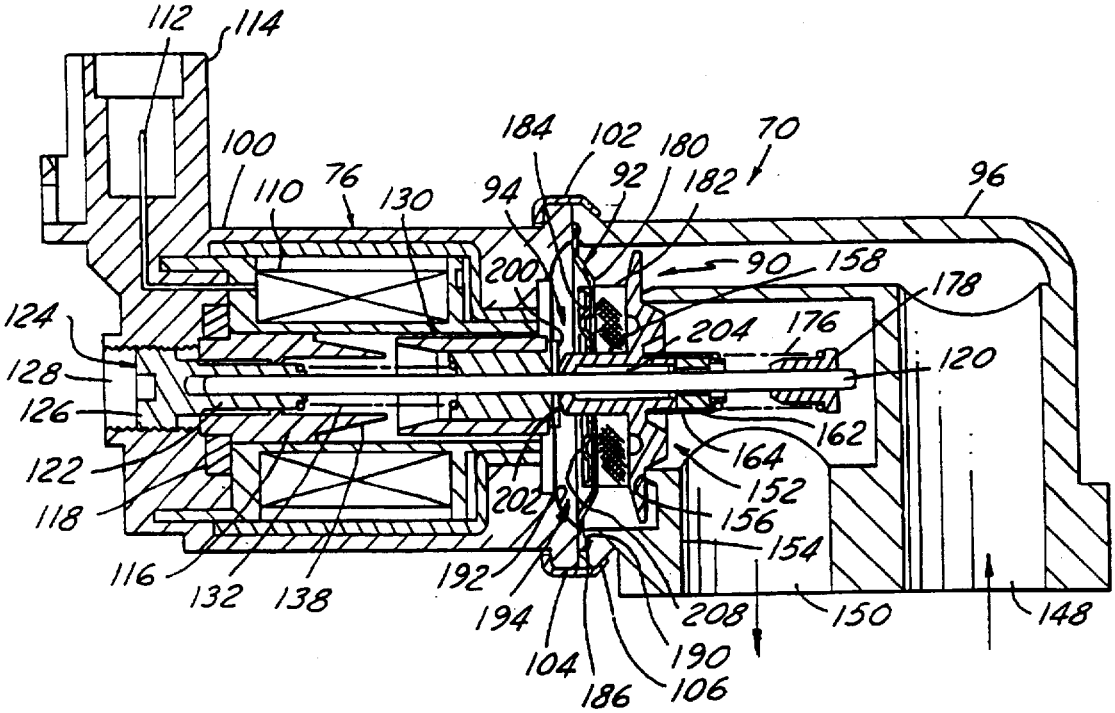
FIG. 2 is a center sectional view of the first embodiment of an idle speed air control device of the present invention with the main valve shown in a fully closed position.
Figure 5:
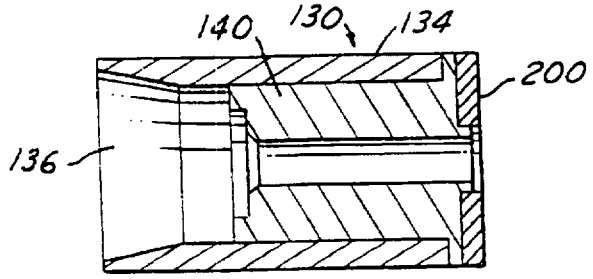
FIG. 5 is an enlarged center sectional view of the solenoid plunger or armature taken generally on line 5—5 of FIG. 4.
Figure 4:
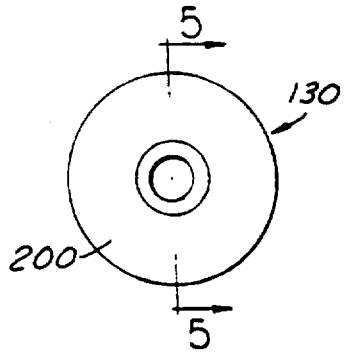
FIG. 4 is an enlarged end view of a solenoid plunger or armature of the device of FIG. 2.
Figure 7:
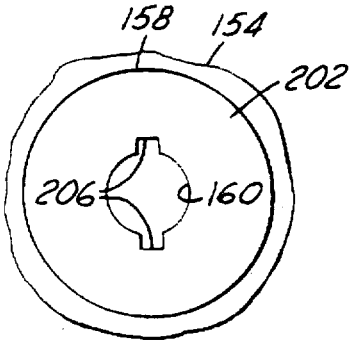
FIG. 7 is a fragmentary end view of the valve of FIG. 6.

As shown in FIG. 2, the bypass air flow device 70 has a main or flow valve assembly 90, an actuator diaphragm assembly 92, and a pilot valve assembly 94, all mounted in a bypass passageway housing 96. The pilot valve is controlled by the solenoid 76 mounted in a casing 100 and secured to the valve housing 96 by a clamp ring 102 encircling mating flanges 104 and 106. The solenoid 76 has an electric coil 110 encapsulated in the casing and electrically connected to the pins 112 of a suitable plug 114 for supplying current to the coil under the command and control of the CPU to energize the coil. An annular core 116 of a ferromagnetic material such as iron is received in one end of the coil and secured therein by a retainer ring 118. A stationary carrier and support rod or shaft 120 is coaxially received in the coil with one end press fit into the shank 22 of an axial adjustment screw 124 with a threaded head 126 received in a complementary threaded bore 128 in the casing. A solenoid armature or plunger 130 is slidably supported on shaft 120 so as to axially movably disposed in the coil. Plunger 130 is yieldably biased towards its extended position (to the right in FIG. 2) by a compression spring 132 received between the plunger and the shank of the screw 124 which permits adjustment of the force produced by the spring urging the plunger to its extended position. As shown in FIGS. 4 and 5, preferably the plunger 130 has an annular sleeve 134 of a ferromagnetic material with a frusto conical bore 136 at its inner end which is complementary with an annular conical portion 138 of the core 116 which it may receive when the plunger is retracted. An inner bushing 140 preferably of plastic material is molded in the sleeve and forms a slide bearing on the stationary pin or rod shaft 120.

The main valve assembly 90 controls the flow of bypass air from an intake passage 148 in the bypass air inlet side of housing 96 to an outlet passage 150 in the bypass air outlet side thereof. The valve assembly 90 has a valve 152 (FIGS.

6 and 7) with an annular closure disk or head 154 engageable with a complementary main valve seat 156 in the housing and an integral hollow stem 158 which in assembly telescopes over and is slidably received on the support pin or shaft 120. At one end the valve stem has a bore 160 journalling with a close sliding fit the valve on shaft 120 and on the other end a rubber grommet 162 is retained on the stem by a retainer cup 164.

Figure 8:
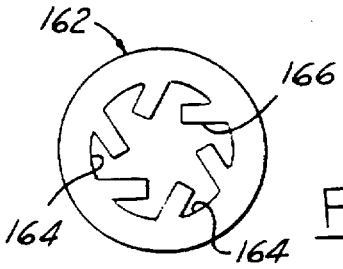
FIG. 8 is an end view of a valve guide grommet of the main valve assembly of the device of FIG. 2.
Figure 9:
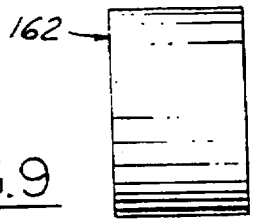
FIG. 9 is a side view of the valve guide grommet of FIG. 10.
Figure 10:
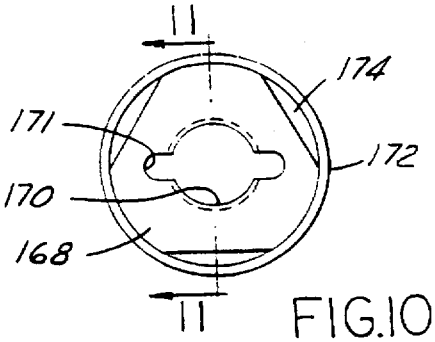
FIG. 10 is an end view of a retainer cup for the valve guide grommet.
Figure 11:
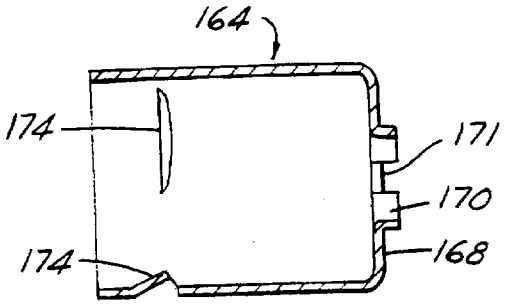
FIG. 11 is a center sectional view taken generally on line 9—9 of FIG. 8 of the retainer cup.

As shown in FIGS. 8 and 9, the grommet 162 has a plurality of spaced apart and generally inwardly projecting fingers 166 which in assembly bear on the slide pin 120 and tend to dampen any fluttering of the valve in use. Passages or slots 164 between the fingers communicate with the interior of the hollow valve stem 158. As shown in FIGS. 10 and 11, the retainer cup has an end wall 168 with a hole 170 through which the pin projects, air flow slots 171, and a side wall 172 with inwardly projecting barbs 174 engageable with the stem to secure the cup and grommet on the stem in coaxial alignment therewith. Preferably, in this first embodiment the valve 152 is yieldably biased toward the plunger by a compression spring 176 (FIG. 2) telescoped over the pin 120 and received between the adjacent valve stem end and a retainer 178 press fit over the guide pin.

Figure 6:
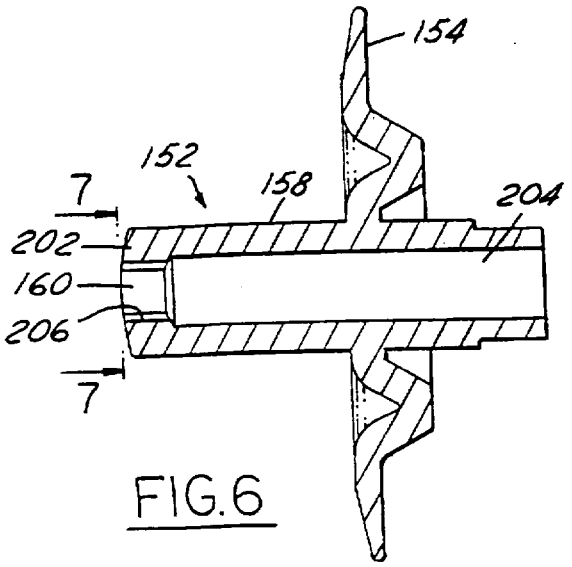
FIG. 6 is an enlarged center sectional view of the main valve of the device of FIG. 2.

The main valve assembly 90 is actuated by a flexible diaphragm 180 with its central portion attached to the valve 152 and sandwiched between an annular air filter 182 and a retainer ring 184 press fit over the stem 158 of the valve. The periphery of the diaphragm has an annular rim 186 received in a complementary groove 190 in the housing and retained in sealed relation with both the valve housing 96 and the solenoid casing 100 by the retainer ring 102 which is spun over their flanges 104 and 106. The diaphragm in cooperation with a recess 192 in the solenoid casing defines a diaphragm chamber 194 (FIG. 2) which communicates with the bypass air outlet passage 150 through the pilot valve assembly 94. The pilot valve assembly has a valve head or closure member 200 (FIG. 5) preferably of a flexible rubber material attached to the end of the plunger 130 which cooperates with a generally spherical seat 202 on the adjacent end face of the stem 158 (FIG. 6). The flexible closure member 200 may also be made of a rubber coated fabric, hard rubber or the like. The seat 202 communicates with the discharge passage 150 through an enlarged counterbore or central passage 204 in the stem and interconnecting recesses or grooves 206 opening into the spherical seat. The diaphragm chamber 194 also communicates through a small vent passage 208 (FIG. 2) in the retainer ring 184 and diaphragm 180, and via the annular air filter 182, with the air intake passage 148 to slowly return the diaphragm chamber 194 to the atmospheric or intake air pressure when both the main valve 90 and the pilot valve 94 are closed as shown in FIG. 2. The filter 182 insures that the air vent 208, diaphragm chamber 194 and pilot valve 94 do not become fouled or plugged with any contaminants in the intake air.

Second Embodiment

Figure 12:
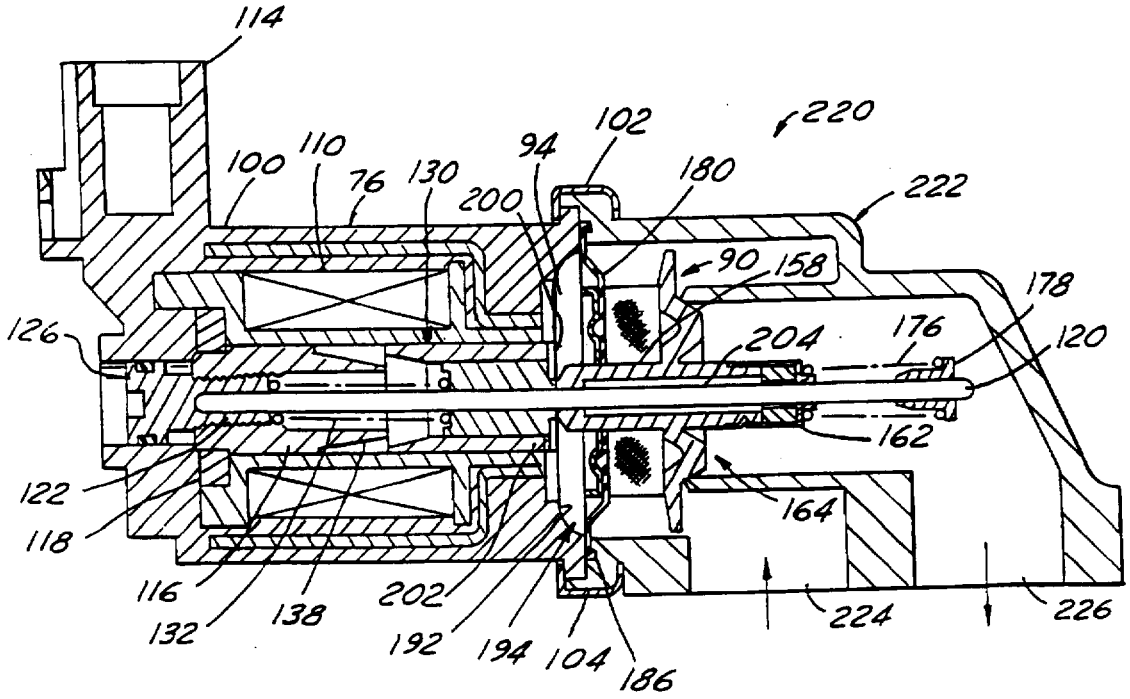
FIG. 12 is a center sectional view of a second embodiment of an idle speed air flow device of the present invention.

FIG. 12 illustrates an air flow device 220 embodying this invention with a modified air bypass passageway housing 222 with a bypass air inlet passage 224 and a bypass air outlet passage 226 which, when mounted on the air intake manifold 52, disposes the solenoid assembly 76 on the upstream side relative to the throttle valve 54, i.e., opposite to the downstream side on which the solenoid assembly 76 of the device 70 is disposed when mounted on the manifold. In the second embodiment device 220, the main valve assembly 90, diaphragm assembly 92, pilot valve assembly 94 and solenoid 76 are the same as that of the first embodiment device 70 and hence will not be described again. The second embodiment device 220 functions and operates in essentially the same manner as the first embodiment device 70. Thus, the location of the solenoid can be changed by simply using a different housing 222 or 96 with the rest of the parts being the same.

Operation of First and Second Embodiments

Figure 3:
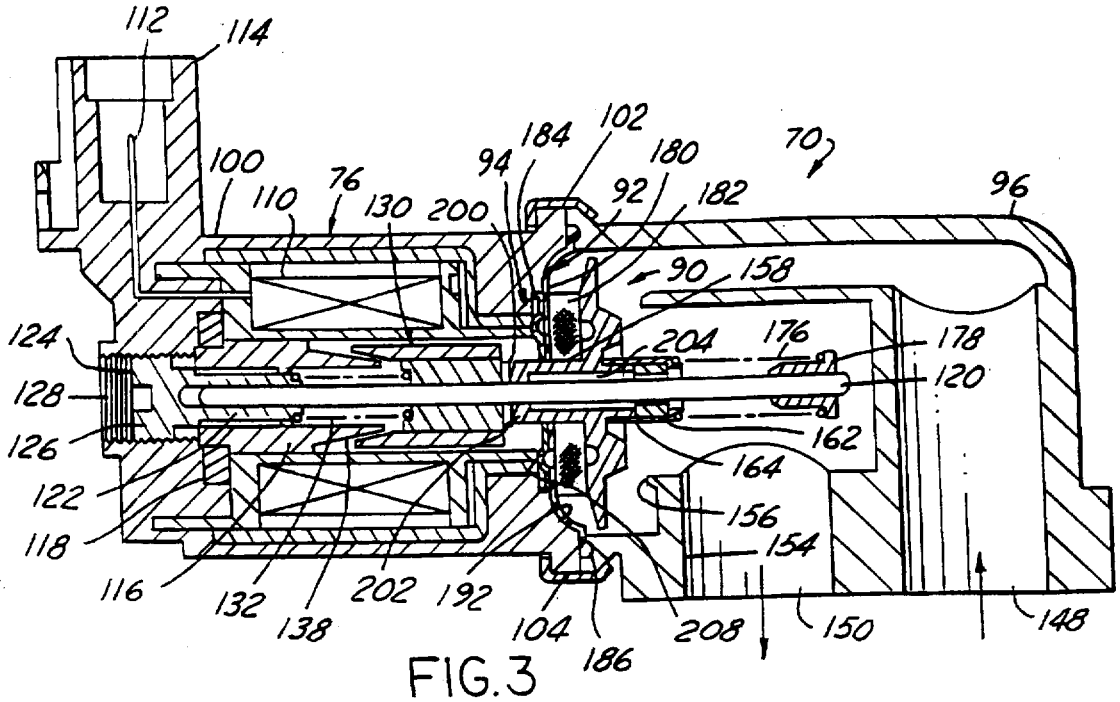
FIG. 3 is a center sectional view of the idle speed air control device of FIG. 2 with the main valve shown in a fully open position.

In operation, when the engine is running a partial vacuum will exist in the intake manifold 52 downstream of the throttle 54 when it is closed. Through the intake manifold port 74 this vacuum is also applied to the outlet passage 150 of the device 70 or the outlet passage 226 of the device 220. So long as the solenoid 76 is de-energized both the pilot valve assembly 94 and the main valve assembly 90 will remain closed as shown in FIG. 2 so that no intake air will flow through the device or be bypassed around the throttle valve 54. While the engine is idling and under appropriate engine operating conditions as determined by the central processing unit 78, it will cause an electric current to be applied to the solenoid 76 in proportion to the quantity of air to be bypassed around the closed throttle valve through the device 70 or 220, and into the intake ports 44 of the engine. Energizing the solenoid moves the plunger 130 to the left (relative to the position shown in FIG. 2) which moves the closure 200 of the pilot valve 94 away from its seat 202, thereby applying the vacuum in the passage 150 (or 226 in device 20) to the diaphragm chamber 194 to actuate the diaphragm 92 to open the main valve 90 as shown in FIG. 3. The vacuum is applied to the diaphragm chamber 194 through the openings 171 in the retainer cap 164 and 166 in the grommet 162, passage 204 through the main valve stem and the recesses 206 communicating with the pilot valve seat 202.

When the engine and flow device are operating under steady state idle conditions, the main valve 90 is opened to whatever position is assumed by plunger 130, i.e., to the point where the seat 202 of the pilot valve 94 almost engages its closure 200 on the plunger 130, and the opposing forces produced on the main valve 90 and diaphragm assembly 92 by the vacuum, intake air flowing through the device, and the bias spring 176 are balanced. However, since the engine operates under dynamic and changing idle conditions, there is a tendency for the pilot valve 92 to be moved by solenoid 76 under the control of the ECU, thereby causing main valve 90 to tend to rapidly open and close with the pilot valve as the main valve slightly hunts or associate with the armature closure 200 in a slightly open position, thus causing the main valve to track the controlled position of plunger 130.

Although atmospheric air flows from passage 148 (or 224) through filter 182 and the small vent passage 208 into diaphragm chamber 194, a vacuum is established and maintained in chamber 194 because the rate of air outflow from chamber 194 is higher than the rate of inflow, the outflow occurring through the outflow path 171, 166, 204 and 206 communicating the vacuum (greater negative pressure) in intake passage 150 (or 226) with the pilot valve seat 202 and thus with diaphragm chamber 194. This inflow and outflow to and from diaphragm chamber 194 is continuous so long as the pilot valve is open. As a result, a pressure differential is produced between passage 148 (or 224) and chamber 194 across diaphragm 180 such that diaphragm 180 is deflected toward solenoid armature plunger 130, thereby drawing pilot valve seat 202 closer to plunger closure member 200 and thus reducing the pilot valve flow controlling cross sectional area. Hence the pilot valve is kept nearly closed as equilibrium is established in accordance with the balance between the vacuum introduced through the pilot valve gap versus the atmospheric pressure leaking into diaphragm chamber 194 through vent orifice 208. In this way the electromagnetic force produced by solenoid assembly 76 is used only to balance the force of spring 132 to thereby only control rather than directly force main valve 90 into its various flow controlling positions. The characteristic linearity of the solenoid can thus be utilized to produce mechanical displacement of plunger 130 which linearly changes in response to the change in solenoid input current magnitude.

Thus, as the main valve 90 is pneumatically forced to travel between its fully closed position as shown in FIG. 2 and its fully open position as shown in FIG. 3, the extent to which it opens is determined by the extent of the displacement or movement of the plunger 130 into the solenoid coil 110, which in turn is determined by the magnitude of the current applied to the coil by the central processing unit 78. Therefore between the closed and fully open positions of the main valve (in the travel of closure 200 between its end limit positions shown in FIGS. 2 and 3 respectively), the rate of flow of bypass air through the device, and/or the flow controlling travel position of the main valve, is proportional to and a function of the magnitude of the electric current applied to the coil 100 of the solenoid, which in turn is determined and controlled by the central processing unit 78. Within limits the force required to initially open the main valve 90 and hence the threshold level of the current applied to the solenoid at which the main valve 90 opens can be varied and adjusted by turning the threaded screw 124 which changes the force applied to the plunger by the compression spring 132.

Third Embodiment

A third embodiment of a bypass intake air control unit 300 of the present invention is illustrated in FIGS. 13 through 30. Those elements of unit 300 identical in structure and function to those of the first and second embodiments 70 and 220 described previously are given like reference numerals, and those elements in unit 300 differing in structure but alike in function to those described previously in units 70 and 220 are given like reference numerals raised by a prime suffix, and the detailed description of such elements not repeated.

Figure 13:
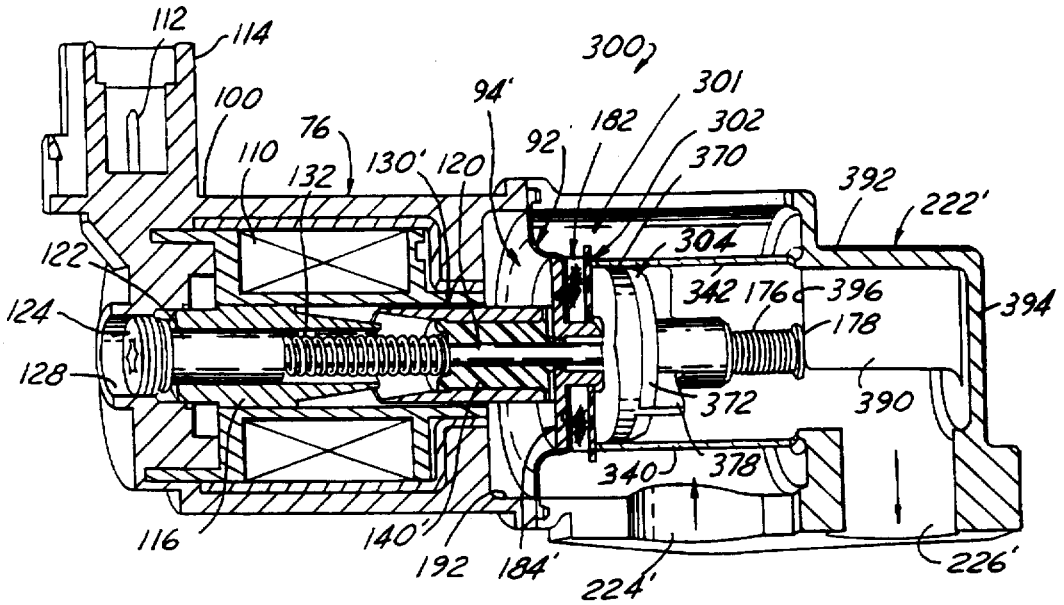
FIG. 13 is a center sectional view of a third embodiment of an idle speed air control device of the present invention with the main valve shown fully closed in a first stage of operation of the device.
Figure 14:
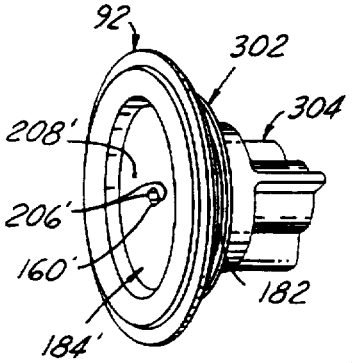
FIG. 14 is a perspective view of the diaphragm, retainer, filter, and two-part main valve subassembly provided in the third embodiment of FIG. 13 but shown by itself.
Figure 15:
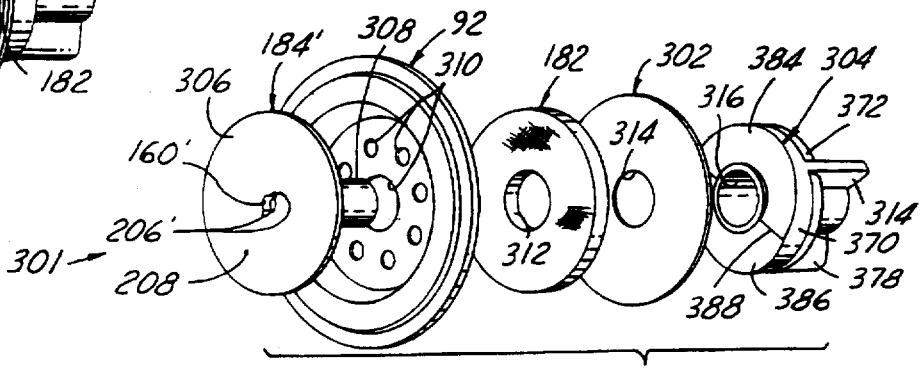
FIG. 15 is an exploded perspective view of the subassembly of FIG. 14.

As best seen in FIGS. 13–17 and 23–27, bypass air flow device 300 has a main valve assembly 301 that includes two discrete but cooperative valve elements, namely a flexible valve disc 302 and an associated valve body 304 which control the flow of bypass air from intake passage 224' in a modified housing 222' to an outlet passage 226' therein. As best seen in FIGS. 14 and 15, valve disc 302 and valve body 304 are fixedly assembled with air filter 182 and diaphragm 92 on a modified retainer 184' for movement as a unitized subassembly on rod 120 in response to pneumatic forces flexing diaphragm 92.

Figure 16:
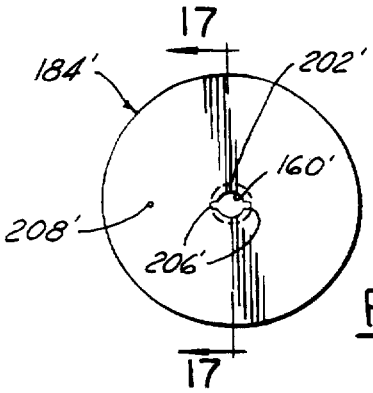
FIG. 16 is an end view of the retainer of the subassembly of FIGS. 14 and 15.
Figure 17:
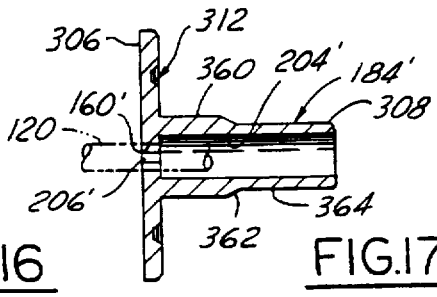
FIG. 17 is a sectional view taken on the line 17—17 of FIG. 16.
Figure 18:
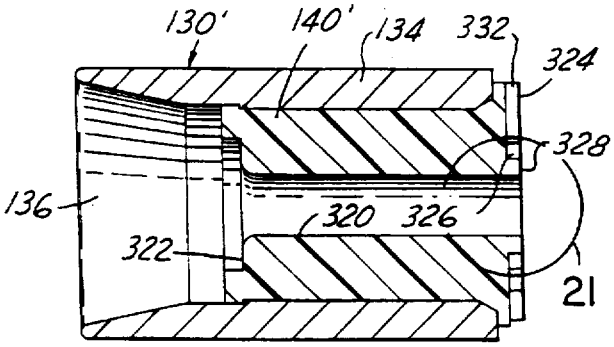
FIG. 18 is a sectional view taken on the line 18—18 of FIG. 19 illustrating a modified solenoid armature subassembly of the third embodiment.
Figure 19:
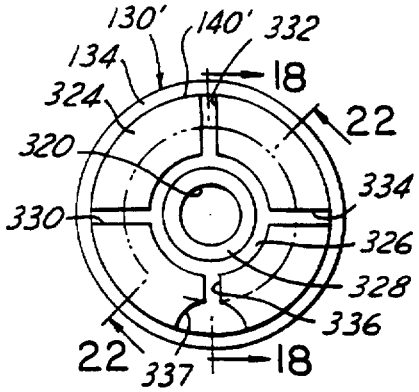
FIG. 19 is an end view of the pilot valve end of the armature subassembly of FIG. 18.
Figure 20:
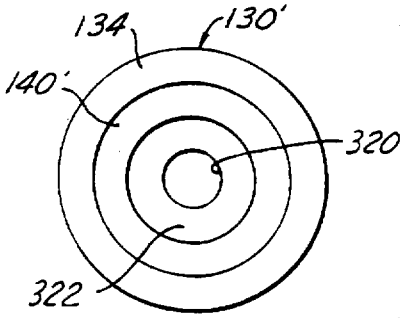
FIG. 20 is an end view of the left hand end of the armature subassembly as viewed in FIG. 18.

Retainer 184' has a head in the form of a flat disc 306 integrally joined to a coaxial tubular stem 308 (FIGS. 16 and 17) as indicated by comparing the exploded view of FIG. 15 with the assembled view of FIG. 14. Retainer stem 308 is inserted coaxially successively through a circular central opening 310 in diaphragm 92, a central opening 312 in air filter 182 and and a central opening in valve disc 302, and then the stem free end is received with a press fit in a central bore 316 of valve body 304 to thereby form the unitized subassembly shown in FIG. 14. Retainer head disc 306 has a central bore 160' sized to have a slip sliding fit on rod 120, as indicated in phantom in FIG. 17. As indicated in FIG. 16, the flat end face surface of head 306 provides a circular marginal area surrounding rod opening 160' that forms the pilot valve seat 202'. Seat 202' communicates with the housing discharge passage 226' via an enlarged counterbore or central passage 204' in retainer stem 308 and the interconnecting diametrically opposed recesses or grooves 206' opening into the annular seat 202', for applying outflow generating engine manifold vacuum pressure to diaphragm chamber 192. Diaphragm chamber 192 is also controllably inflow vented at lesser flow rate to the substantially atmospheric pressure in intake passage 224' via the annular air filter 182, a circular row of holes 310 in diaphragm 92 covered by the air filter and which register with an annular channel or groove 312 in the rear face of retainer head 306. Groove 312 in turn communicates with the calibrated orifice 208' (FIGS. 15 and 16) opening through retainer head 306 into diaphragm chamber 192.

As best seen in FIGS. 18–22, the third embodiment air flow device 300 is provided with a modified solenoid armature or plunger 130' utilizing the same annular sleeve 134 made of a ferromagnetic material, such as stainless steel, but with a modified inner bushing 140' preferably insert molded into sleeve 134. Preferably bushing 140' is made of a lightweight composite plastic material such as 65% glass/mineral filled PPS material, such as that sold under the trademark "FORTRON" 6165A4 by Hoescht Celanese Corporation. Bushing 140' has a central throughbore 320 sized for slidably receiving rod 120 therethrough and opening at its rear end to a spring seat 322 for receiving the associated end of spring 132 (FIG. 13).

Figure 21:
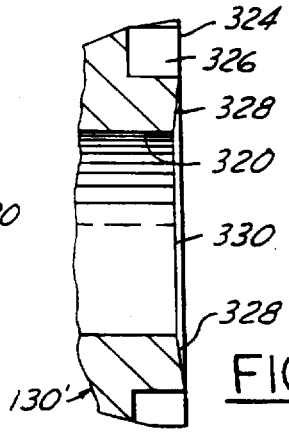
FIG. 21 is a greatly enlarged fragmentary view of the portion encompassed by the circle 21 in FIG. 18.
Figure 22:
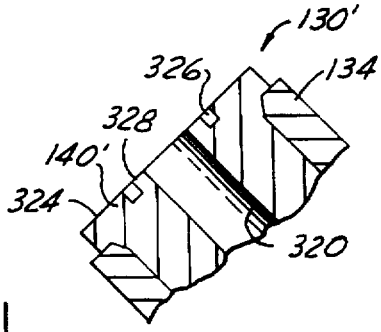
FIG. 22 is a fragmentary sectional view taken on the line 22—22 of FIG. 19.
Figure 23:
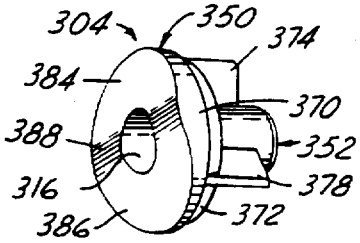
FIG. 23 is a perspective view of the poppet valve body of FIGS. 14 and 15 shown by itself.

The front end face 324 of bushing 140 is itself configured to form the closure member of the pilot valve assembly, and hence the rubber closure member 200 of plunger 130 is omitted. An annular groove 326 is formed in end face 324 concentric with bore 320 and spaced radially outwardly therefrom to define a ring-like valve seat 328. The radially outer edge of seat 326 at the intersection with groove 326 is flush with the plane of end face 324 (FIG. 21), and the surface of seat 328 is made very slightly concave such that its edge intersection 330 with bushing bore 320 is slightly axially inset from the plane of plunger end face 324 (FIG. 21). Four radially extending grooves 330, 332, 334 and 336 are also formed in end face 324 at 90° angular increments for communicating annular groove 326 with the periphery of bushing 140' to thereby and thus diaphragm chamber 192 with seat ring 328. In the closed condition of the pilot valve, plunger seat ring 328 is adapted to abut the valve seat zone 202' of retainer head 306 (FIG. 16) and to close off communication of the notches 206' with the diaphragm chamber 192. Due to the reduced diameter of plunger closure ring seat 328 as compared to that of the rubber closure disc 200 of plunger 130, a reduced "break-away" solenoid force is required to disengage plunger 130' from the face of retainer head 306 when the main valve assembly is closed (and the air pressure conditions in passages 224' and 226' are exerting a closing force on the pilot valve assembly) because of the resultant reduction in working surface area of the pilot valve assembly. The slight concavity of plunger ring seat 328 also assists in promoting a rapid "break away" action of the plunger from retainer face 306, thereby providing a lower initiation force of pilot valve operation.

The provision of a composite solenoid armature plunger 130' utilizing a lightweight plastic bushing 140', like the construction of plunger 130 described previously, results in a considerable reduction in the inertial mass of the solenoid armature, as compared to the one-piece all-metal solenoid armature assemblies of prior art bypass intake air flow controlled devices. Hence the air flow device is less subject to erratic operation and loss of control by the ECU when the armature plunger is adversely subjected to extreme acceleration and deceleration forces generated from abrupt changes in vehicle velocity, as when applying the brakes hard. For example, in some applications the orientation of the air flow between manifold 52 and devices 70, 220 or 300 can align the direction of travel of the armature 130, 130' generally parallel to the action of such adverse forces thereby allowing such forces to adversely affect the balance of forces acting between the solenoid armature and its biasing spring 132. This in turn can adversely affect the desired linearity between solenoid input current magnitude and armature travel. Accordingly, the reduced mass of the armature plunger helps reduce the adverse impact of such adverse inertial forces which may be encountered in an unusual vehicle operations modes.

In accordance with a further and principal feature of the third embodiment air flow control device 300, the main valve is made up of two sequentially active air flow controlling components, namely (1) the flexible valve disc 302 and (2) the valve body 304, thereby providing a multi-stage operational effect which can be readily modified by initial design to suit the diverse requirements of various automotive engine applications, and eliminating the need to reprogram the software of the ECU to reestablish standard bypass air flow characteristics.

Valve disc 302 in the third embodiment of device 300 is preferably made of a material similar to that of diaphragm 92, for example, a rubber-like flexible material consisting of a fiber filled fabric, such as that sold under the trademark DICRON, coated with 100% flourosilicon synthetic rubber material but made somewhat thicker and heavier (e.g., 0.30 inches) than the type of diaphragm material normally employed, for example, in diaphragm fuel pumps and diaphragm fuel flow regulators of diaphragm carburetors. For example, in one working embodiment valve disc 302 was constructed to have an outside diameter about 0.30 inches greater than that of valve seat 156.

Housing 222' of unit 300 is also modified in certain respects as compared to housing 222 described previously. The upstream inlet portion of the bypass air discharge passage 226' is formed by a sleeve 340 having a inside cylindrical surface 342 of precise and constant diameter extending from its open end edge 156' (last seen in FIGS. 29 and 30) axially at least for the travel distance of valve body 304 within sleeve 340. Edge 156' forms the annular main valve seat for the main valve assembly 301 and corresponds to valve seat 156 of the first and second embodiments. The outside diameter of disc 302 is made larger than the diameter of seat 156', and in the closed condition of main valve assembly 301 (as shown in FIG. 13) valve disc 302 is drawn by engine suction forces to tightly sealably engage valve seat 156' to thereby completely close communication between housing intake passageway 224' and discharge passageway 226' assuming pilot valve assembly 94' likewise being in closed condition. Due to the flexible nature of disc 302 and the pliability of its rubber coated fabric construction, the same readily conforms to any manufacturing irregularities in the valve seat edge 156' so that the same can be more economically manufactured to wider tolerances without adversely affecting the bypass air flow shut-off characteristics of main valve assembly 301.

Figure 24:
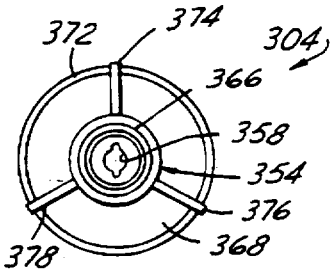
FIGS. 24 is a rear end view of the valve the main valve assembly shown by itself.
Figure 27:
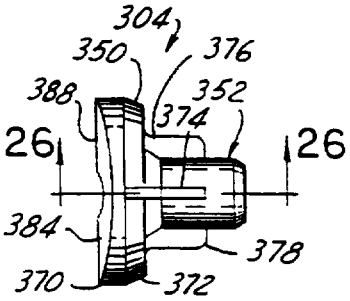
FIG. 27 is a side elevational view of the valve body of FIGS. 24–26 but rotated about is axis 90° relative thereto.
Figure 26:
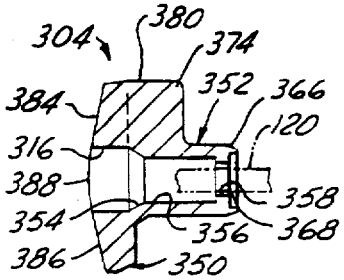
FIG. 26 is a cross sectional view taken on the line 26—26 of FIG. 27.
Figure 25:
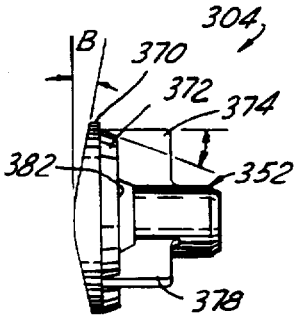
FIG. 25 is a side elevational view of the valve body of FIG. 24 oriented as illustrated in FIG. 13.

The other principal operative component of the main valve assembly 301 is the valve body 304, which is constructed as illustrated in perspective in FIGS. 13–15 and as shown in more detail in the views of FIGS. 23–27. Valve body 304 thus has a piston-like configuration with a generally cylindrical piston head 350 and a tubular shank 352 coaxial with the head. As best seen in FIGS. 24 and 26, valve body 304 has a central through-passageway made up of the entrance bore 316, a conical neck 354, a reduced diameter counterbore 356 and a rod journal bore 358 formed in the rear wall of stem sleeve 352. Bores 316, 354 and 356 are complemental respectively to portions 360, 362 and 364 (FIG. 17) of stem sleeve 308 of retainer 184' for slip press fit thereon in assembly. Bore 358 slidably receives rod 120 (FIG. 26), and a vent passageway is formed in the rear wall of stem 352 by a pair of diametrically opposite notches 366 and 368 (FIGS. 24 and 26) that communicate the negative air pressure in discharge passage 226' with the interior clearance space in retainer bore 204' surrounding rod 120 received therethrough. This space in turn communicates via the retainer notches 206' (FIGS. 16 and 17) with diaphragm chamber 192 under the control of the pilot valve closure ring 328.

In accordance with a further feature of the invention, the head 350 of valve body 304 is formed at its periphery with a cylindrical surface 370 sized to have a predetermined diametrical clearance, e.g., 0.010 inches, with the inside bore surface 342 of sleeve 340. The trailing peripheral surface 372 of the periphery of piston head 350 is made conical to merge at its upstream edge with surface 370, is convergent therefrom in a downstream direction at a predetermined conical angle A (FIG. 25), e.g., 22°. The axial dimensions of surfaces 370 and 372 are also predetermined parameters, for example, 4.95 millimeters and 2.03 millimeters respectively.

Valve body 304 also has three thin guide fins 374, 376 and 378 protruding radially outwardly from stem sleeve 352 and spaced circumferentially at 120° therearound. The axially extending outer edges 380 (FIG. 26) of the fins have a slight sliding clearance with bore surface 342 for slidably guiding and centering body 304 therein in all axial travel positions of valve assembly 301.

Figure 28:
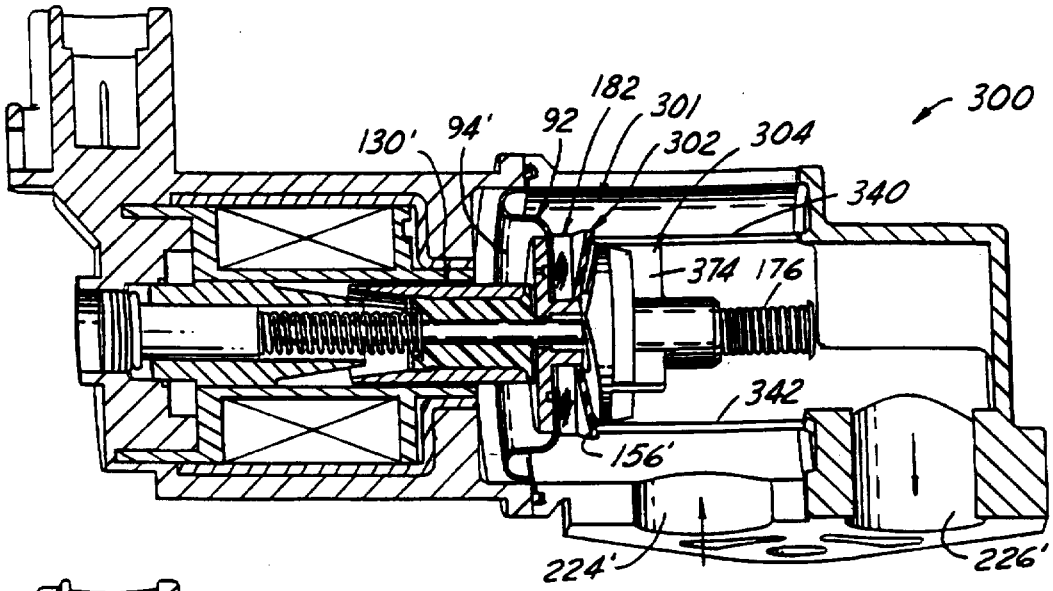
FIGS. 28, 29 and 30 are center sectional views of the third embodiment device, similar to FIG. 13, but illustrating successive second, third and fourth stages of operation of the same.

Hence so long as valve body 304 is axially positioned in sleeve bore 342 with the axial extent of cylindrical head surface 370 retracted to register with the bore, i.e., in the positions shown in FIGS. 13 and 28, the cross sectional passageway area controlling bypass air flow from inlet passage 224' to discharge passage 226' is determined by the diametrical clearance (established by design) between surface 370 and bore surface 342 of sleeve 340. When valve body 304 is moved by diaphragm 92 to the left from the position of FIG. 28 to that of FIG. 29 to register the junction of surfaces 372 and 370 with valve seat 156', the flow controlling cross section area is then determined by the clearance (established by design) between conical surface 372 and valve seat 156'. Thus during further axial travel of main valve assembly 301 to the left from the position of FIG. 29 and until the rear face 382 of head 350 registers with valve seat 156', the flow controlling cross sectional passageway area gradually increases as a function of incremental axial travel versus taper angle A of conical surface 372. Once rear face 382 of head 350 clears the open end of sleeve, i.e., valve seat 156', the flow controlling cross sectional passageway area rapidly increases as a function of axial travel of main valve assembly 301 as determined by the axial spacing of the radially extending rear face 382 of valve head 350 away from valve seat 156' until valve assembly 301 reaches its full open stop position of FIG. 30.

In accordance with a further feature of the third embodiment device 300 of the invention, the fully closed condition of main valve assembly 301 as shown in FIG. 13, is effected by the flexible valve disc 302 being forced flat against valve seat 156', and hence valve body 304 is a passive control element in this mode. This condition is maintained when the engine is running and pilot valve 94' is being maintained closed so that the air pressure forces acting on diaphragm 92 in chambers 192 and passage 224' are balanced by the atmospheric bleed vent 208'. The pressure differential between bypass passages 224' and 226' is then forcing the flexible valve disc 182 tightly against valve seat 156'.

It will be further noted that valve head 350 of the valve body 304 has a front face in the form of a shallow angle wedge as defined by two angled planar surfaces 384 and 386 which converge centrally of head 350 to merge at diametrical extending apex zone 388. Hence when valve body 304 is held retracted within sleeve 340 by system pressure in the completely closed condition shown in FIG. 13, only the diametrical apex zone 388 of the front face of body head 350 contacts the corresponding surface zone of valve disc 302. When main valve assembly 301, under the control of the pilot valve assembly 94', is initially moved by the action of diaphragm 92 to begin its opening travel (to the left as viewed in FIGS. 13 and 28–30) the "wedging" action of the head face apex 388 in conjunction with the rearwardly tapering flanking faces 384 and 386 will produce a progressive "peel-off" action of valve disc 302 from valve seat 156'. This produces a pair of progressive and gradually increasing gaps or flow openings at the diametrically opposite side edges of disc 302 relative to the plane of the valve seat 156' (i.e., this plane being preferably perpendicular to the axis of main valve assembly 301 and to the direction of main valve movement). The pressure differential between inlet passage 224' and discharge passage 226', even as bypass air initially flows through the peeled open gaps, continues to force the unpeeled portions of valve disc 302 tightly against valve seat 156'. When the front face of head 350 has traveled axially sufficiently to wedge unpeel all of the sealing surface area of valve disc 302 away from valve seat 156', i.e., a position intermediate those shown in FIGS. 28 and 29, the primary flow controlling element of the main valve assembly will now consist of the clearance space between head surface 370 and bore surface 342, and valve disc 302 will return to its relaxed free state planar condition shown in FIG. 29.

A further feature of the third embodiment device 300 of the invention is the provision of a thin blade like stop member 390 (FIG. 13) which protrudes downwardly in the discharge passageway 226' from the upper wall 392 of housing 22' and forwardly from the rear wall 394 of the housing. Stop 390 is thin in cross section and is oriented with the plane of its major length and the width dimensions parallel to the direction of air flow in passage 226' so as to present a minimal obstruction to such flow. The leading edge 396 of stop 390 is oriented to extend closely adjacent to spring stop rivet 178 at the free end of rod 120 so as to intersect the axis of rod 120.

Thin wall stop 390 provides an inexpensive fail safe feature for device 300 in the event that the rivet or grommet 178, initially fixed in manufacture on the free end of rod 120, becomes unfastened from the rod as a result of prolonged and abnormal usage. Although there is a slight axial spacing between the end of rod 120, and likewise the end of rivet 170, closest to rib stop edge 396, the length of the stem of the rivet (see FIG. 2) is sufficient so if it breaks loose on rod 120, the rivet will slide under the biasing force of spring 176 only far enough to hit stop edge 396. This is a small enough distance to prevent rivet 178 from completely telescoping off the free end of rod 120. Hence the control device 300 remains operable for engine shut off opening of the main valve as desired for cold cranking because there is a back stop for maintaining spring 176 in action in the event of any such rivet failure.

Operation of Third Embodiment

Figure 30:
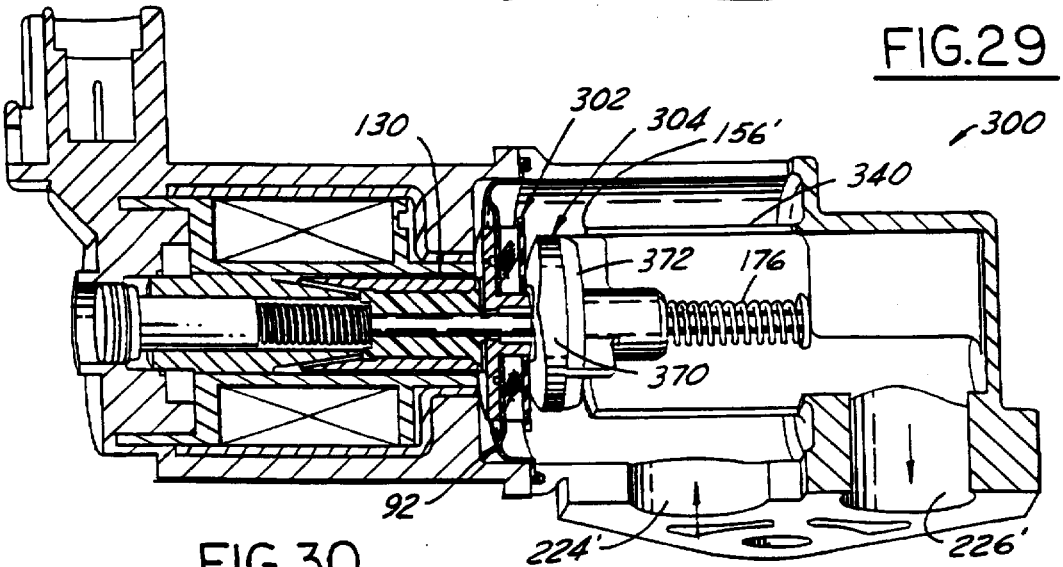

As noted previously in connection with the first and second embodiments of FIGS. 1–12, when the vehicle engine is shut off and no current is being applied to solenoid 130 or 130', the main valve assembly 90 of the first and second embodiments and valve assembly 301 of the third embodiment are held in the wide open position of FIGS. 3 and 30 respectively. Under these conditions, the fluid pressure forces on diaphragm 92 is balanced by the atmospheric bleed to the diaphragm chamber 192, and hence the main valve assembly is positioned by the balance of forces between springs 176 and 132, spring 176 being designed to develop a greater biasing force than spring 132. Hence bypass units 70, 220 and 300 are conditioned to provide maximum throttle bypass flow during "cold-cranking", i.e., engine air intake flow induced by piston reciprocation prior to the engine firing and beginning to run under its own power. In this condition, the pilot valve 94 and 94' is maintained closed by the oppositely acting biasing forces of springs 132 and 176.

As soon as the engine fires and begins running under its own power, the corresponding sudden increase in engine vacuum manifold pressure developed between bypass inlet passageways 150, 224 and 224' versus the bypass discharge passageways 148, 226 and 226' respectively will produce a pressure differential on the opposite faces of diaphragm 92, as well as on the working surfaces of the main valve assemblies 152, 301, acting to rapidly force the main valve assembly to the completely closed condition of FIGS. 2, 12 and 13. The main valve assembly is then placed under the control of the engine control unit 78 and its various engine operational condition sensors 80, 82 and 84 to apply the appropriate magnitude (% of duty cycle) of energizing current to solenoid 76 to produce a predetermined corresponding amount of axial travel to the solenoid armatures 130 and 130' (to the left as viewed in the drawings). The axial travel position of solenoids 130, 130' is preferably a linear function of solenoid energizing current in a range above initial break-away force magnitude, i.e., that required for initially unseating the pilot valve closures 200 and 328 from their associated pilot valve seats 202 and 202' respectively.

Communication is then opened by the pilot valve between diaphragm chamber 192 and the vacuum pressure in the discharge passageways 148, 226 or 226' through the internal passages of the main valve assembly, allowing air to be withdrawn from diaphragm chamber 192 at a faster rate than it can be replenished through the atmospheric bleed into this chamber from the inlet passages 148, 224 or 224'. The air pressure differential thus developed on diaphragm 92 provides pneumatic forces for producing corresponding travel of the main valve assembly to the left as viewed in the drawings, thus simultaneously tending to cause the pilot valve to reclose by moving seats 202 and 202' to "catch up" with the axially displaced closures 200 and 328. However, as the suction draw from the diaphragm chamber 192 is thereby reduced by closing the gap or axial spread between the pilot valve closure and its seat, the continuing atmospheric bleed into diaphragm chamber 192 will reduce the absolute negative pressure developed therein, thereby tending to rebalance the air pressure differential forces acting on the diaphragm, and allowing the system bypass air pressure conditions acting on both the diaphragm and the main valve assembly to tend to reopen the pilot valve gap. As the pilot gap is reopened or enlarged, absolute negative pressure in diaphragm chamber 192 is thereby again increased, thus again tending to reclose the pilot valve.

This "hunting" action thus causes the main valve assembly to "track" whatever axial travel position is being held by the solenoid armature plunger 130, 130', which in turn is a function of the magnitude of solenoid energizing current acting against the force of solenoid spring 132. It will also be seen that during axial travel of the main valve assembly between fully closed and fully opened positions, the biasing forces of spring 176 are isolated from acting on armature solenoid 130'. Hence it is solely the pneumatic forces acting on diaphragm 92 and on the main valve assemblies which produces essentially a non-contact nearly closed tracking condition between the solenoid armature plunger and the pilot valve seats of the main valve assembly because the biasing forces of spring 176 cannot be transmitted to act on solenoid plungers 130, 130' during such controlled travel.

The sequence of operation of device 300 is illustrated sequentially in FIGS. 13, 28, 29 and 30. The peeling-open action of valve disc 302 occurs as the valve assembly 301 moves from the fully closed condition of FIG. 13 to the partially open condition of FIG. 24. As valve body 304 moves from the position of FIG. 28 to that of FIG. 29, bypass air flow control is governed primarily by the diametrical clearance between piston head surface 370 and bore surface 342 as the primary flow controlling cross sectional area.

In the next opening stage, as the trailing conical surface 372 of valve body 304 travels past valve seat 156' the flow controlling cross sectional area gradually increases in accordance with the conical taper angle A of this surface. Once the rear radial face 382 of head 350 clears valve seat 156' during further travel in the opening direction, the much greater opening clearance between rear face 382 and valve seat 156' becomes the primary flow controlling cross sectional area, and continues as such, until valve assembly 301' reaches it fully open condition shown in FIG. 30. In this position, as in the previous embodiment the pilot valve remains slightly open due to the aforementioned "hunting" action, thereby continuing to maintain positional control over the main valve assembly.

During closing movement of the main valve assembly the sequence is repeated in reverse. When valve disc 302 is axially travel positioned to initially touch valve seat 156', i.e., at its diametrically opposite peripheral edge portions perpendicular to the face apex 388 of valve body 304, the bypass air flow conditions and pressure differentials between passageway 224' and 226' will tend to reseat valve disc 302 with a "peel-on" action as permitted by further travel of valve body 304 into bore 342 under control of the pilot valve solenoid.

Figure 31:
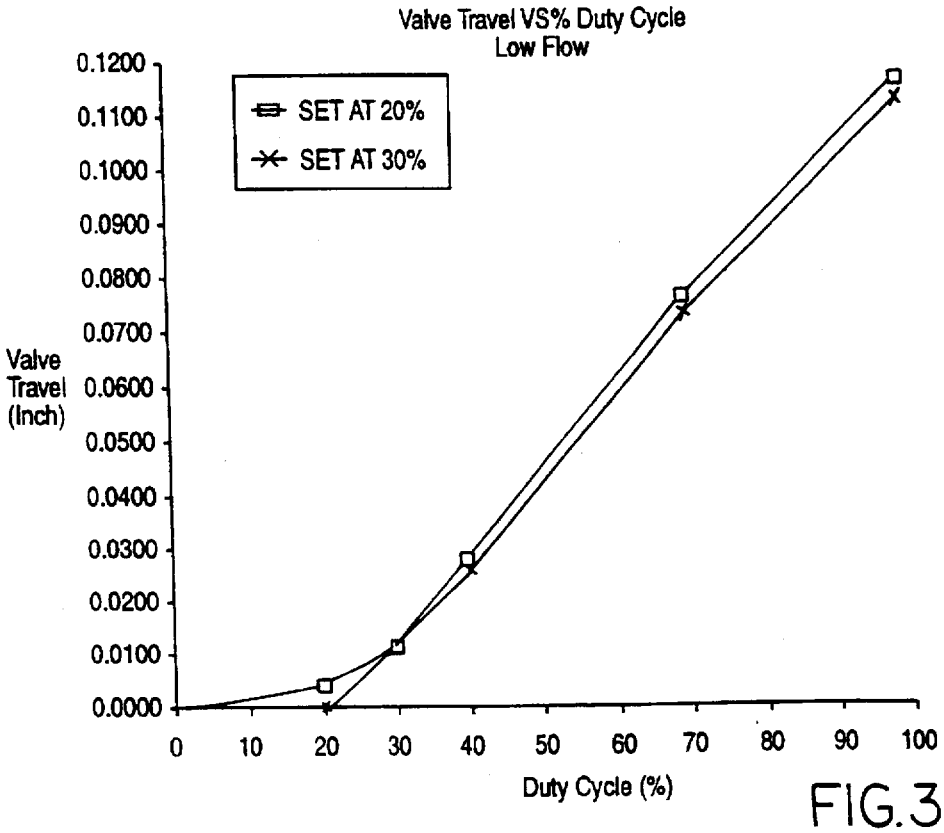
FIGS. 31 and 32 are graphs plotting main valve travel versus percent duty cycle solenoid current under respective low flow and high flow test conditions as performed with low flow sized and high flow sized versions of the first embodiment.

Because of the foregoing mode of pneumatic force main valve operation, the desired characteristic relationship of solenoid plunger axial position or travel versus magnitude of solenoid energy current will remain as a linear function. This can be seen by referring to the graphs of FIGS. 31 and 32, wherein the resultant axial travel of the main valve assembly, as it follows the armature plunger in the aforementioned hunting tracking action, plots from test results of device 70 as a linear function of the duty cycle of applied armature current to the solenoid (the current magnitude being expressed in terms of percent duty cycle in view of the conventional pulse width modulated type of operation of the typical ECU program and control). FIG. 31 shows this relationship of main valve assembly travel versus armature current magnitude expressed in percent duty cycle under "low flow" conditions for two system set points, one curve showing test results with armature set to initiate axial travel at 20% duty cycle and the other curve with the setting at 30% duty cycle. "Low flow" is defined by one OEM vehicle manufacturer as a bypass flow control device constructed so that, at wide open condition of the main bypass valve, the device must be capable of a minimum bypass air flow rate of 49.8 kilograms of air per hour at about 72° F. at sea level for an applied air pressure drop of 16 inches of mercury.

Figure 32:
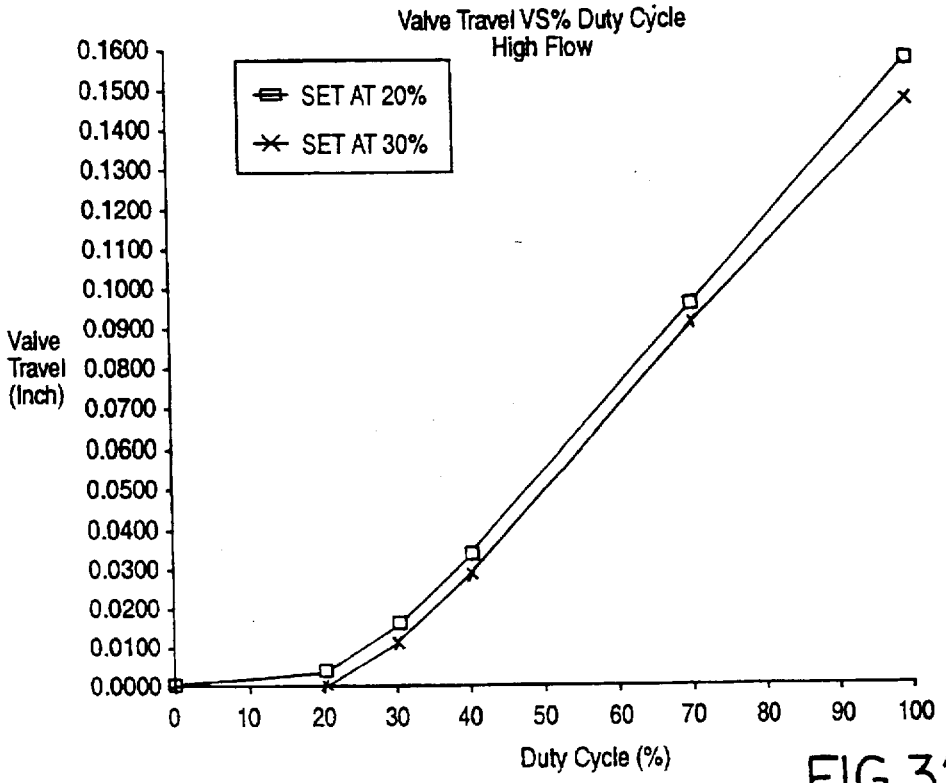

Likewise, FIG. 32 illustrates the test results of the bypass air control device (as constructed in accordance with the foregoing disclosure of the first embodiment) with similar initial set points under "high flow" conditions. "High flow" is similarly defined as a minimum bypass air flow rate of 63.6 Kg/hr.

Figure 33:
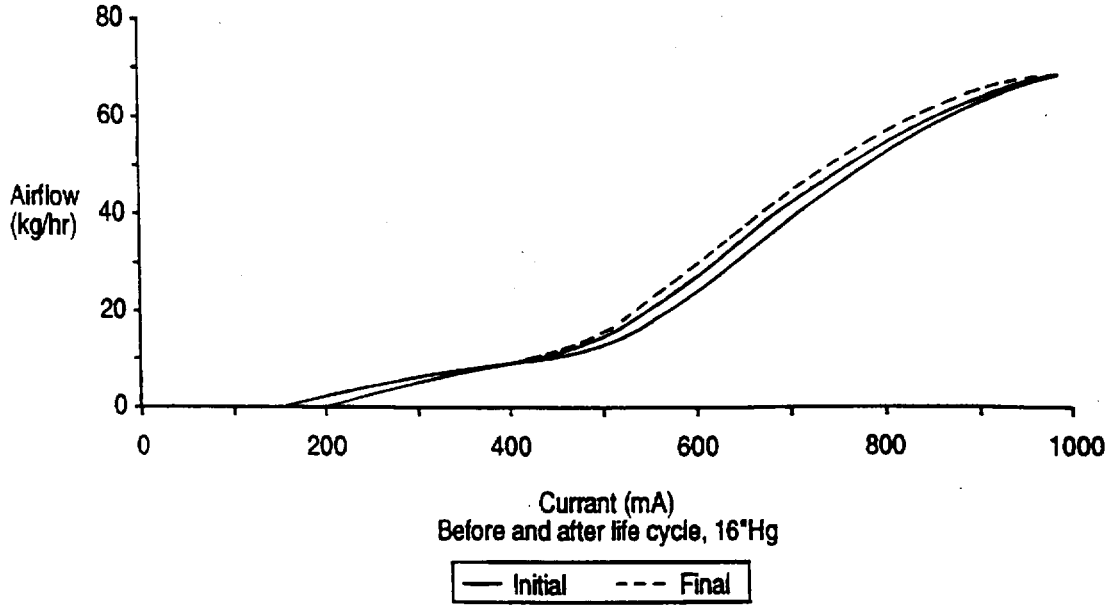
FIG. 33 is a graph showing a performance plot of air flow versus solenoid current of the high flow sized version of the first embodiment under test conditions.

Referring to FIG. 33, the corresponding resultant control of bypass air flow expressed in kilograms per hour versus solenoid armature energizing current expressed in milliamperes is shown as a plot of data based on the test results of the bypass air flow control device constructed in accordance with the first embodiment of FIGS. 1–11 as described previously. The solid line curve plots test results obtained during initial testing of the device, wherein the broken line curve plots test results obtained after completion of life cycle testing of the device, each that using sixteen inches of mercury as a constant manifold pressure draw.

Figure 34:
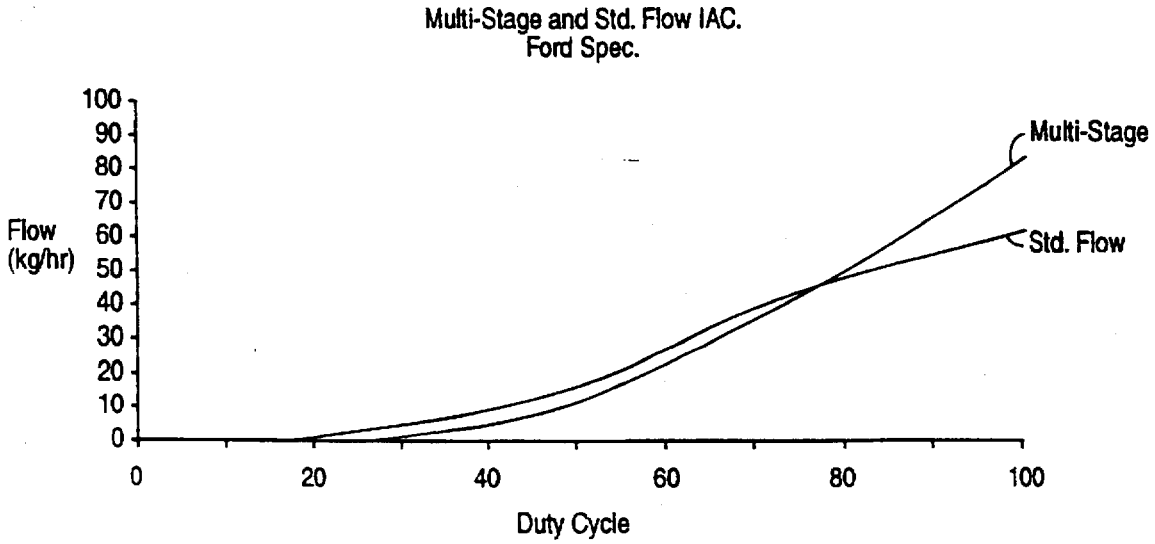
FIG. 34 is a graph illustrating the performance of a multi-stage idle air control unit constructed in accordance with the third embodiment of the invention as disclosed herein versus that specified as a standard by one OEM automotive vehicle manufacturer, in terms of air flow bypassed through the unit as a function of duty cycle percentage of applied solenoid current.

Referring to FIG. 34 which is a graph similar to that of FIG. 33 (plotting bypass air flow in kilograms per hour versus solenoid energy current expressed as percentage of duty cycle) it will be seen that the curve labeled "standard flow" represents a typical existing bypass air flow specification set forth as a standard by one OEM vehicle manufacturer. It will be seen by comparing the curves of FIG. 33 with the standard flow curve of FIG. 34 that the test results obtained with the first embodiment of FIGS. 1–11 substantially corresponds to the standard flow curve, and thus meets this standard specification.

However, with the construction of the further improved idle air flow control device 300 of the third embodiment of the invention described previously, the foregoing multistage action of the modified main valve assembly 301 enables bypass air flow control characteristics to be obtained by empirically establishing initial design parameters, which can exceed the aforementioned specified "standard flow curve" of FIG. 34. For example, in one embodiment constructed in accordance with the third embodiment as described in conjunction with FIGS. 13–30 air flow test results were obtained as set forth in the curve of FIG. 34 labeled "multi-stage". Note that a linear control of air flow from about 30% duty cycle to about 50% duty cycle was obtained to thereby precisely control bypass air flow to produce a test curve plot that tracks the standard flow curve but at about half the flow valves of the standard flow specification. Then from about 50% duty cycle to 100% duty cycle flow control linearity was obtained, but this characteristic was maintained in a higher flow range, i.e., in the duty cycle range of about 80 to 100% and the flow range of about 50 to 100 kilograms per hour. This enhanced performance characteristic is obtainable in the third embodiment by empirically varying the various flow cross section geometrical parameters of only one simple mechanical component, namely the valve body 304 of main valve assembly 301.

These flow controlling geometrical shape parameters can be varied by initial design, correlated with the linear axial travel of main valve assembly 301, the latter valve remaining the same relative to armature percent duty cycle current magnitude as in the first and second embodiments and as shown by way of example in the graphs of FIGS. 31 and 32. Thus the designer now has readily at hand the following geometrical design parameters to easily vary at low manufacturing cost, valve body 304:

1. Diametrical clearance between the piston head cylindrical surface 370 and bore surface 342;

2. Axial extent of the cylindrical surface 370;

3. Taper angle A of the conical trailing surface 372 of head 350 of valve body 304;

4. Axial extent of conical surface 372;

5. Angle B of the wedge taper of front faces 384 and 386 of head 350 of body 304 (see FIG. 25).

Thus the air flow device 300 of the invention can be readily adapted by empirical design of valve body 304 to readily meet the requirements of a variety of types of engines, which may and typically do require different flow rate or bypass air flow metering characteristics, without requiring the OEM vehicle manufacture to reprogram or provide different operational software for the particular engine control unit (ECU) system provided for a specific vehicle.

Fourth Embodiment

Figure 35:
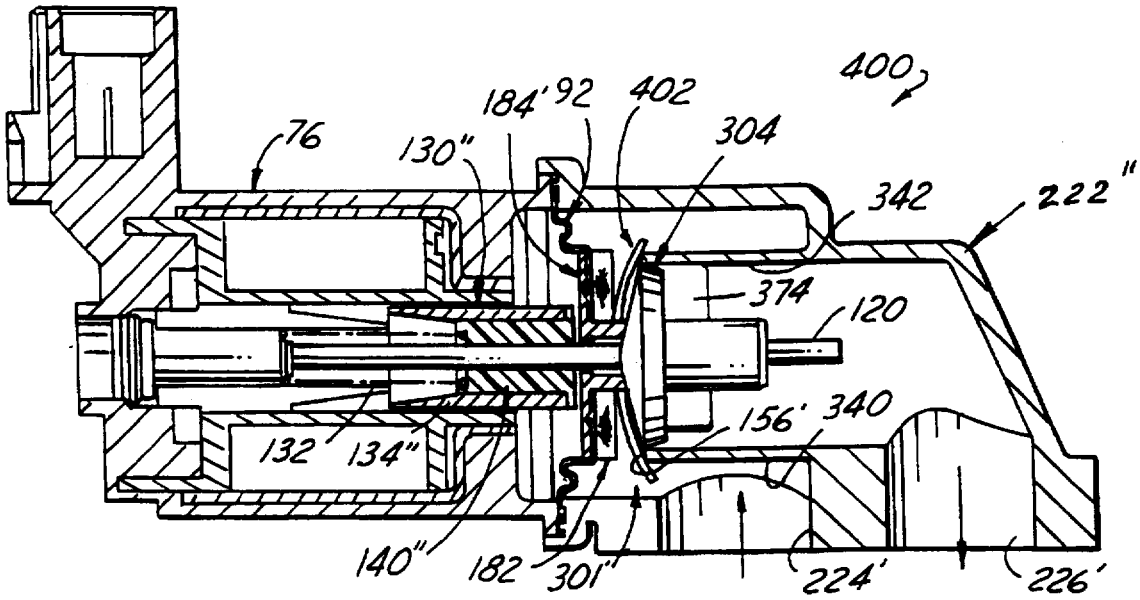
FIG. 35 is a center sectional view of a fourth embodiment device of the invention containing a modified two-part main valve subassembly.
Figure 37:
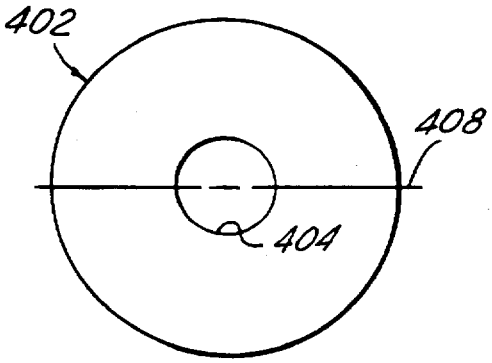
FIG. 37 is an end view of the valve disc of FIG. 36.
Figure 36:
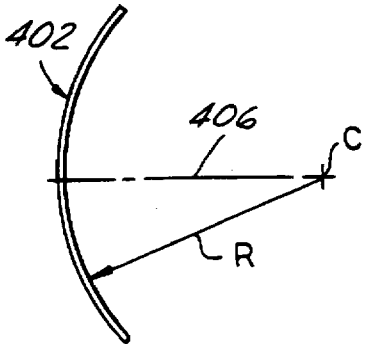
FIG. 36 is a side view of the spring disc valve member of the two-part main valve assembly of the fourth embodiment.

A fourth embodiment of an idle bypass air flow control device 400 of the invention is illustrated in FIGS. 35–38. Device 400 is constructed similar to the third embodiment device 300 except as indicated hereinafter. Device 400 has a modified main valve assembly 301' employing a modified valve disc 402 (FIGS. 35–37) made from a thin sheet of spring metal, preferably 430 stainless steel with a thickness of 0.13 millimeters. Disc 402 is made circular and has an outside diameter the same or similar to that of the flexible fabric valve disc 302, and likewise has a concentric center opening 404 for close fit slip-on mounting on the diametrically enlarged portion 360 of stem 308 of retainer 184'. Disc 402 is formed so as to have in its free state a curvature about a single radius R (FIG. 36) drawn from a center C on a line 406 perpendicular to a diametrical apex line 408 centered on the disc (FIG. 37). In one working example the outside diameter of disc 402 in a flat condition was 25.4 millimeters, and radius R was 23 millimeters. In assembly of disc 402 in main valve assembly 301', the apex 388 of the face of piston head 350 of valve body 304 is aligned with apex 408 of disc 402, as shown in FIG. 35.

Due to its resilience and curved free state condition, valve disc 402 functions as both a spring and a valve closure member in device 400. The spring stress of disc 402 is designed to balance that of solenoid spring 132 to maintain a minimum main valve open position in the absence of piston fluid pressure differential forces existing in the bypass control unit. Hence in the engine-off condition, disc 402 will bias main valve assembly 301 open at least as far as the open condition illustrated in FIG. 35 so that the bypass control unit 400 can bypass sufficient manifold air flow around throttle valve 54 during cold cranking of the engine. Note that the valve opening bias spring 176 and its associated rivet stop 178 of device 300 is thereby eliminated in device 400.

When the engine fires in response to cranking, and while the pilot valve is being maintained closed by spring 132 and valve disc 402 acting as a counter spring, the pressure differential thereby created between the inlet passageway 224' and outlet passageway 226' will draw valve assembly 301' to a fully closed condition (a position to the right of that shown in FIG. 29 and identical to that shown in FIG. 13), valve disc 402 being flexed by such forces to a fully flat condition to seat fully closed against the main valve seat 156'.

Figure 29:
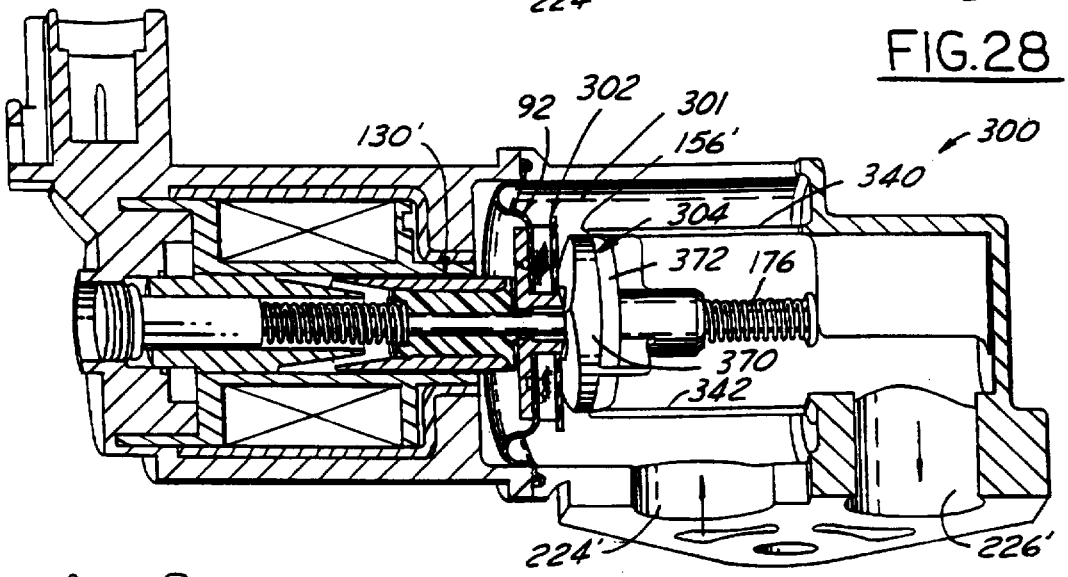

This thus shuts off any bypass air flow through device 400 when the pilot valve is actuated by the engine control unit to initially open the same and thereby cause pneumatic forces acting on diaphragm 92 to move valve assembly 301' in its first opening increment of axial travel from fully closed position (to the left as viewed in FIG. 29). Again, a "peeling-open" action on valve disc 402 will occur both due to the wedge face push of piston head 350 of valve body 304 and the cooperative spring stress of disc 402 tending to return it to its free state curvature. Control device 400 thus enables control of bypass air flow with the same multi-stage action as the third embodiment device 300 but is less costly in construction due spring valve disc 402 eliminating spring 176, grommet rivet 178 and stop 390.

Figure 39:
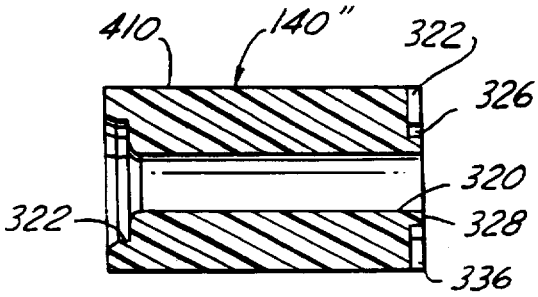
FIG. 39 is a cross section view taken on the line 39—39 of FIG. 38.
Figure 38:
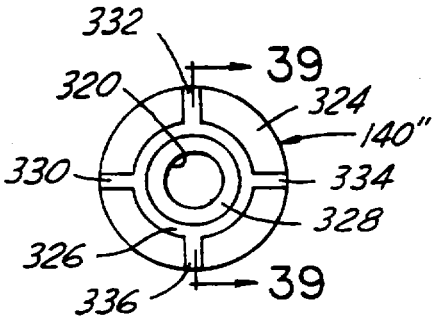
FIG. 38 is an end view illustrating the modified pilot valve end of a modified armature core employed in the fourth embodiment.

Another feature of control device 400 is a modified armature plunger core insert 140" as shown separately in FIGS. 38 and 39 and in assembly in FIG. 35. Armature core 140" has a cylindrical peripheral surface 410 designed for press-in and/or adhesive bonding fixation in armature sleeve 134" rather than being an in-situ molded insert as in plunger 130'. The pilot valve closure face of insert 140" is constructed in a manner similar to that of insert 140' except that the crescent shaped mold gate cavity 337 (FIG. 19) is eliminated and hence radial vent passage 336 is thus made identical to the remaining passages 330, 332 and 334 as illustrated in FIGS. 37, 38 and 39. As so constructed, armature insert sleeve 140" is still preferably made of a wear resistant, lightweight plastic composite material to reduce the mass of the armature plunger 130" and with a low co-efficient of friction to function well as a slide bearing on the fixed rod 120.

Fifth Embodiment

A fifth embodiment of a bypass intake air control device 500 of the present invention is illustrated in FIGS. 40–43. In the device 500, the main valve assembly 90, diaphragm assembly 92, pilot valve assembly 94 and solenoid 76 are the same as that of the first two embodiments 70, 220 already described and hence will not be described again.

Figure 40:
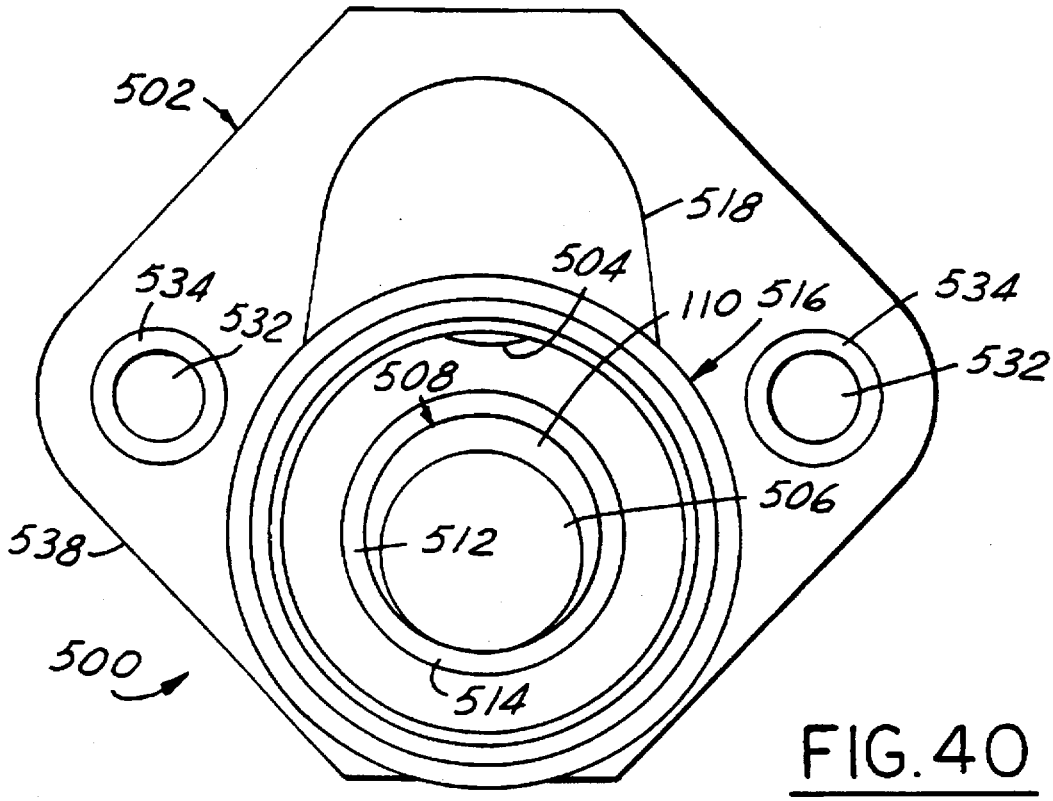
FIG. 40 is a top view of the housing of a fifth embodiment of the present invention.

As shown in FIG. 40, a housing 502 has an inlet passage 504, an outlet passage 506 and a cylindrical bore passage 508 adjacent to the outlet passage 506. Preferably, the cylindrical bore passage 508 is coaxial with the outlet passage 506 and has a side wall 510 which defines the outlet passage 506. The free end 512 of the cylindrical bore passage 508 provides an annular seat 514 constructed to communicate with the valve assembly 90 to open and close the outlet passage 508 as previously described.

For mounting the diaphragm and solenoid 76, the housing also has a cylindrical wall 516 which is preferably coaxial with both the outlet passage 506 and the cylindrical bore passage 508 and telescopically receives the cylindrical bore passage 508 therein such that the wall 516 extends axially beyond the upper end 512 of the cylindrical bore passage 508. Preferably, a cover 518 overlies the inlet passage 504 and is disposed adjacent to and opens into the cylindrical wall 516 such that the inlet passage 504 is in communication with the outlet passage 506 when the valve 90 is open.

Figure 42:
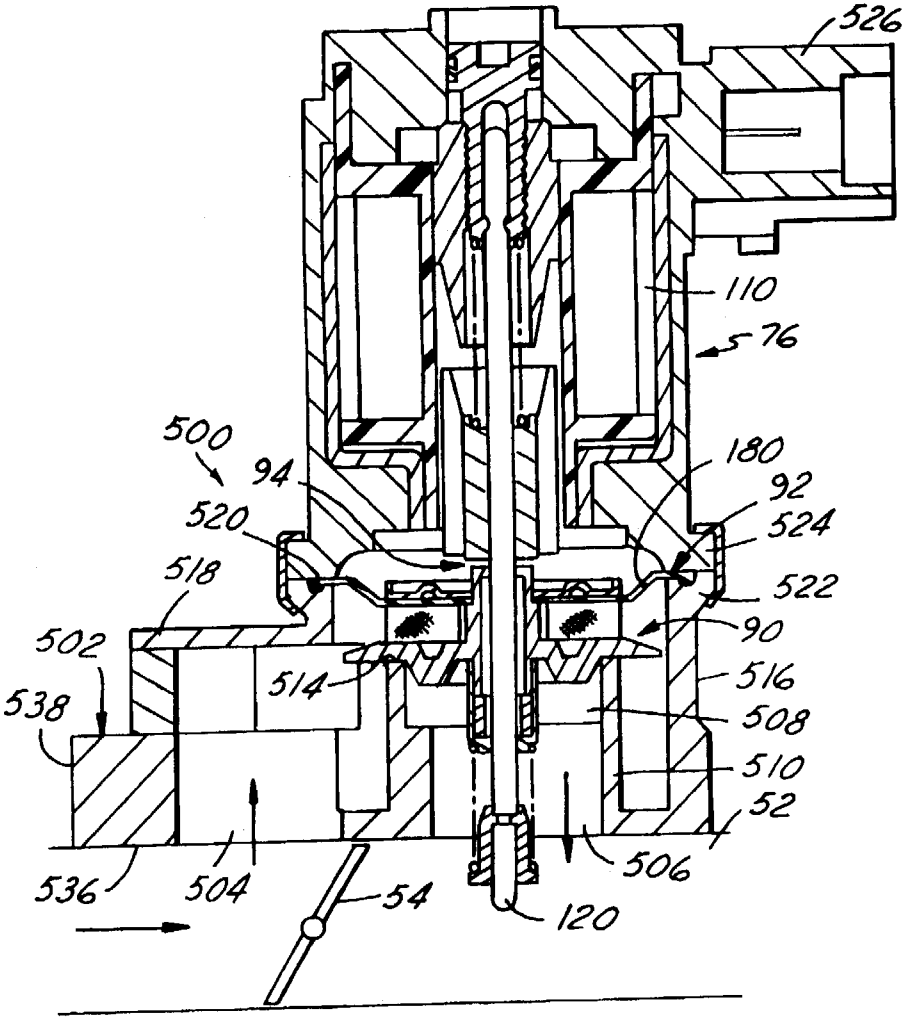
FIG. 42 is a center sectional view of the fifth embodiment.

To receive, retain and seal the outer edge of the diaphragm, preferably, the top of the wall 516 is provided with an annular groove 520 in which a peripheral bead of the diaphragm is received. Also preferably, as shown in FIG. 42, an annular flange 522 is provided adjacent the upper end of the wall 516 and the solenoid assembly 76 has a complementary annular flange 524 coaxial with the coil 110 of the solenoid 76 to securely fasten the solenoid 76 and diaphragm 180 to the housing 502. The complementary, mating annular flanges 522, 524 also allow rotation of the solenoid 76 relative to the housing 502 to facilitate orienting the solenoid relative to the engine for electrical connection of the solenoid 76. As shown, an electrical plug 526 which provides the electrical input to the solenoid extends to the right of the solenoid 76 in FIG. 42. With the flange 522, 524 construction as noted, the solenoid 76 can be rotated relative to the housing 502 to circumferentially position the electrical plug 526 of the solenoid 76 relative to the housing and engine as needed.

To securely fasten the housing 502 to the air intake manifold 52 a pair of mounting holes 532 are provided in the housing 502. Preferably, a metal bushing 534 is molded within each mounting hole 532 to facilitate firmly connecting the housing 502 to the manifold 52 without excessive stress or clamping force being applied to the housing.

Figure 41:
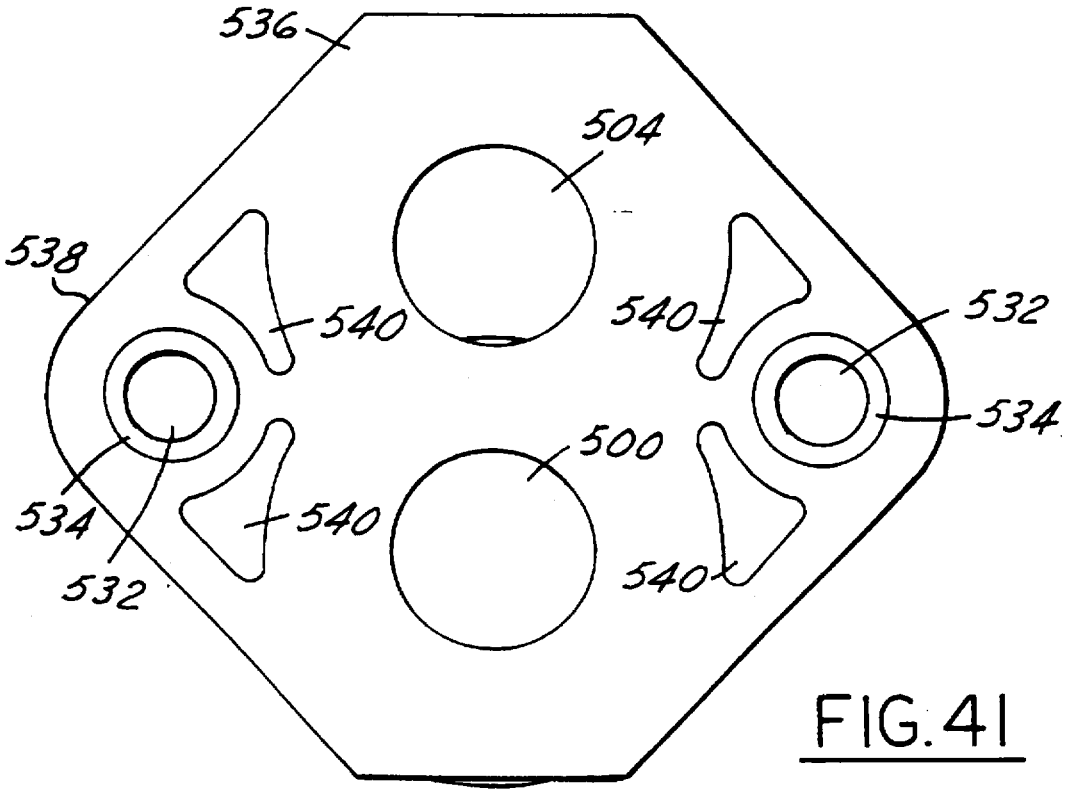
FIG. 41 is a bottom view of the housing of the fifth embodiment.

As shown in FIG. 41, preferably, the mounting surface 536 of the housing is substantially flat and constructed to be sealed with an air intake manifold 52. The inlet 504 and outlet 506 passages, as well as both mounting holes 532, are open to the mounting surface 536. Preferably the inlet 504 and outlet 506 passages are disposed symmetrically about the mounting flange 538 relative to each other and the mounting holes 532. This symmetry enables the housing 502 to be rotated 180° to reverse the positions of the inlet 504 and outlet 506 passages relative to the throttle valve 54 and facilitates alignment of the housing 502 on the manifold 52.

Preferably, the housing 502 is formed of a plastic material such as a glass-reinforced, heat- stabilized nylon such as ASTM D 4066. To accommodate shrinkage which can occur adjacent the mounting holes 532 during the molding process, a pair of cavities 540 are preferably formed in the mounting surface 536 adjacent to each mounting hole 532.

As shown in FIG. 42, the solenoid 76 is disposed on the housing 502 with the outer edge of the diaphragm 180 received in the annular groove 520 formed in the top of the cylindrical wall 516 of the housing 502. A banding member 542 disposed about the periphery of the flange 522 of the cylindrical wall 516 and the flange 524 of the solenoid 76 securely fastens the solenoid 76 and the diaphragm to the housing.

Preferably, the solenoid 76, main valve assembly 90 and rod 120 are substantially coaxial with the outlet passage 506 and substantially perpendicular to the mounting surface 536 of the housing 502. The device 500 is disposed on the manifold 52 so that the inlet passage 504 is upstream of the throttle valve 54 and the outlet passage 506 is downstream of the throttle valve 54 relative to the air flow in the manifold 52 as indicated by the arrows in FIG. 42.

Figure 43:
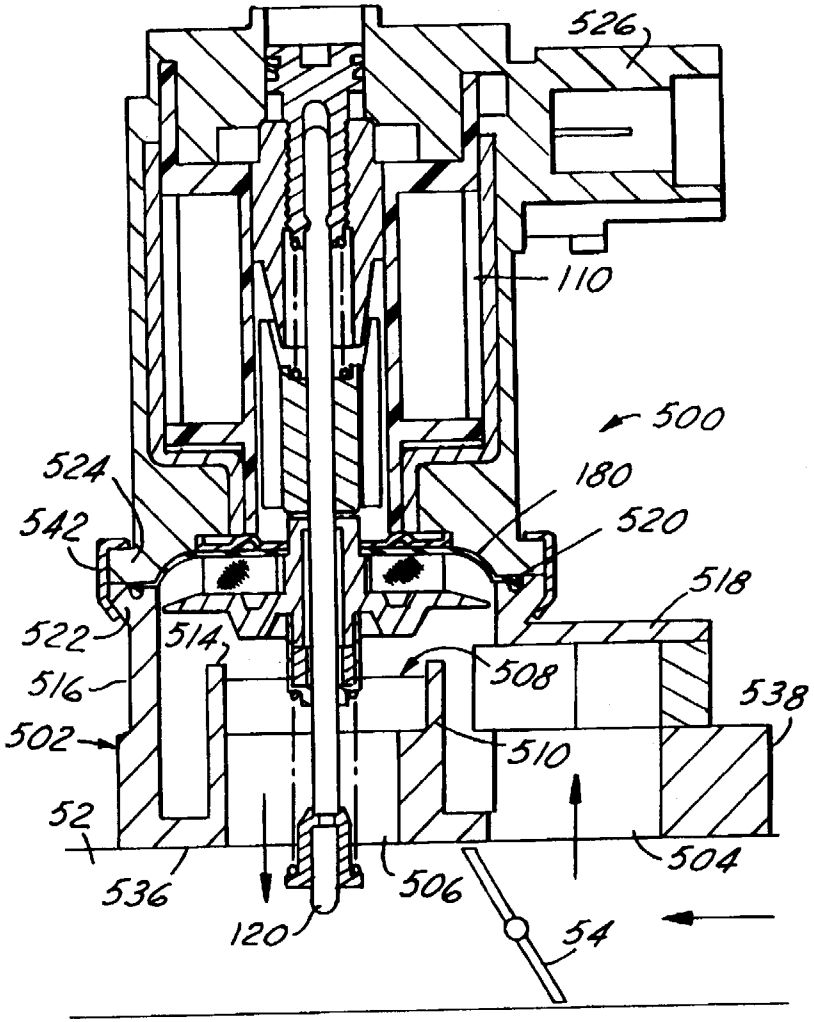
FIG. 43 is a center sectional view of the fifth embodiment illustrating the housing rotated to position the solenoid downstream of the throttle valve in a reverse flow (as compared to the direction of flow in FIG. 42) air intake manifold.

FIG. 43 illustrates the device 500 disposed on an intake manifold 52' having an air flow direction from right to left (as indicated by the arrows in FIG. 43) opposite to the air flow direction of the manifold 52. To position the inlet passage 504 of the housing 502 upstream of the throttle valve 54, the housing 502 has been rotated 180° relative to its position shown in FIG. 42. This rotation of the housing 502 positions the outlet passage 506 to the left of the throttle valve 54 in FIG. 43, or downstream of the throttle valve 54. The solenoid 76, main valve assembly 90 and rod 120 remain substantially coaxial with the outlet passage 506 and are hence, also located downstream of the throttle valve 54. Again, as in FIG. 42, the solenoid 76, main valve assembly 90 and rod 120 are disposed substantially perpendicular to the mounting surface 536 of the housing 500.

As shown in FIGS. 42 and 43, the same housing 502 and solenoid 76 combination can be used with manifolds 52 and 52' having opposite flow directions by simply rotating the housing 180°. Further, the housing 502 of this embodiment positions the axis of the solenoid 76 substantially perpendicular to the mounting surface 536 of the housing 502 and also allows the solenoid 76 to be rotated relative to of the housing 502 to position the electrical plug 526 of the solenoid 76 as needed.

Advantages

In addition to those advantages set forth hereinabove, in all five disclosed embodiments of the invention it will be noted that all moving parts are carried on the single rod 120 which in turn is fixed (preferably adjustably) to the solenoid casing 76. Hence during manufacture spring 132, plunger 130, 130', 130" as well as all of the components of the main valve assembly 90, 301, 301' can be sequentially subassembled as a stack-up on rod 120 separate and apart from the air passageway housing 96, 222 or 222' or 222". Then in final assembly the bypass housing is readily slipped into place and secured in final assembly by the clamp ring 102 encircling the mating flanges of the casing and housing. In final assembly of the cantilevered mount of rod 120 in the casing and housing, the seating action of either the conical shoulder 155 on the rear side of head 154 of valve 152, as shown in FIG. 6, or preferably the slide guide action of the guide fins 374, 376 and 378 of main valve assembly 301, 301', produce a self centering action of the main valve on valve seat 156. This eliminates the need to provide precise and costly manufacturing alignment between axial aligned support bores for supporting the opposite ends of a moving rod-type support of the main valve assembly and solenoid armature such as present in the prior art devices illustrated in FIGS. 1 and 2 of the aforementioned U.S. Pat. No. 4,823,750. The mounting of the pilot valve components on the same fixed rod presents loss of precise pilot valve control action otherwise occurring because of solely cantilevered support of the hollow stem 105 of the FIG. 6 embodiment of the aforementioned '750 patent.

In addition to preventing clogging of the air control passageways for the pilot valve, filter 182 of the main valve assembly in all embodiments provides a wear cushion for diaphragm 92, and in the third and fourth embodiments for the adjacent valve disc 302, 402 as well. Since filter 182 is located upstream of the atmospheric inlet to diaphragm chamber 192, and control air always flows in only one direction through this passageway first into the diaphragm chamber 192 and then out of the same through the pilot valve controlled suction passageway through the main valve assembly, both the inlet and outlet air control passageways to the diaphragm chamber are maintained free of clogging from contaminants drawn into the main intake passageway 56 of the engine.

In the third embodiment device 300 the flexible but non-resilient valve disc 302 is able to sealably conform to minor irregularities in valve seat 156', thereby allowing wider manufacturing tolerances on this seat.

In the preferred embodiment devices 300 and 400 of the invention, a broader range of air flow options is made available simply by modifying the design of the valve body 304 as described previously. Additionally, linear air flow performance can be obtained over a wider range of air flow rates, as illustrated by the comparison curves of FIG. 34. The linearity of axial travel of the main valve assembly can thus be translated into differing air flow curves as desired to better match differing vehicle engine operational parameters without altering the engine control unit operational parameters and control functions. Due to the peel-off and peel-on action obtained in the third and fourth embodiments, the low end flow curve between the first stage of FIG. 13 and the second stage of FIG. 28 can be made substantially linear, if desired, but with a different slope (rate of change) from mid or high end flow curve as bypass flow rate is increased in response to further axial travel of the main valve assembly, (i.e., between the second stage position of FIG. 28 and the fourth stage position of FIG. 30).

The geometrical modifications required in reshaping valve body 304 are economically achievable by making minor alterations in the shape and dimensions of this part. The rate of peel-off and peel-on of valve disc 302 and 402 also can be readily altered by changing the wedge angle of the head faces 384 and 386.

The guide fins 374, 376, 378 of valve body 304 also provide better support of the main valve assembly throughout its range of travel against vehicle vibration and inertial shock stresses, as when the vehicle is suddenly braked. This stabilization also reduces the chances of ripping or damaging the fabric valve disc 302. In the third embodiment device 300, the thin wall stop 390 provides an inexpensive fail-safe feature which does not adversely affect flow resistance of the bypass control passages.

In all embodiments the two-piece solenoid armature plunger provides significantly reduced inertial mass and hence better and more reliable bypass control operation because the solenoid is less affected by adverse externally generated environmental forces, such as gravity and inertial and momentum forces generated by sudden changes in vehicle direction and/or velocity during vehicle travel.

In the third and fourth embodiments the reduced diameter of the pilot valve closure member of ring 328 and the radial bleed passages feeding the surrounding concentric groove 326 provide more sensitive pilot valve operation to maintain more precise control of main valve assembly travel position. This feature also significantly reduces the initial unseating force required to initially open the pilot valve. Hence a lower initial set point can be obtained and utilized for armature current magnitude to initiate pilot valve operation.

The multi-stage bypass idle air flow devices 300 and 400 thus provide a "universal" control unit capable of very accurate bypass air control at "low end" air flow rates while also achieving accurate control at "high end" flow rates even exceeding prior devices constructed large enough to satisfy the aforementioned "High Flow" specification. Thus only one size of devices 300 and 400 need be constructed to meet the requirements of both small and large displacement engines.

Further, with the substantially symmetrical and hence, rotatable housing 502 of the fifth embodiment 500, a single bypass air flow device can be used with manifolds 52 having opposite flow directions. The housing 502 also positions the solenoid 76 generally perpendicular to the mounting surface 536 of the housing 502 to provide a more compact and easily located bypass air flow device.

What is claimed is:

1. An idle speed bypass air control device for bypassing air around an intake throttle valve of an engine comprising, a housing having an air inlet passage, an air outlet passage and a first valve seat received between them, a solenoid carried by the housing having an electric coil and a movable plunger, an axially elongated slide rod disposed generally coaxially with the coil, the plunger being slidably received on the rod for movement relative to the rod and the coil, a main valve slidably received on the rod and movable relative to the plunger and the seat, the main valve being movable on the rod to a closed position engagable with the seat and to open positions disengaged and spaced from the seat, a diaphragm carried by the housing for actuating the main valve and with one face defining in part a chamber and the other face communicating with the inlet passage, a second valve seat carried by the main valve for movement therewith and communicating with the diaphragm chamber and the outlet passage, and a pilot valve carried by the plunger and movable by the plunger to a closed position in engagement with the second seat and to an open position disengaged and spaced from the second seat, whereby when the engine is operating with the throttle valve in a closed position and a subatmospheric pressure is applied to the outlet passage of the device, the opening of the main valve by the diaphragm is a function of and proportional to an electric signal applied to the coil of the solenoid.

2. A device as defined in claim 1 in which said main valve comprises a disc having radially extending portions to contact said first valve seat and an axially extending projection centrally of said disc and with a surface slidably contacting said slide rod, said projection having at least one axial slot through the surface contacting said slide rod providing at least one passage communicating the second valve seat with the outlet passage.

3. A device as defined in claim 2 in which said projection has a grommet positioned axially on said projection, said grommet having resilient fingers contacting said slide rod to frictionally engage said slide rod and at least one axial through passage in communication with said axial passage in said projection, and a retainer retaining said grommet on said projection.

4. A device as defined in claim 2 in which a resilient means is mounted on said projection having a resilient portion in contact with said slide rod to provide frictional engagement with said slide rod.

5. A device as defined in claim 1 which also comprises an annular skirt extending coaxially with said slide rod and from one end of said housing toward said main valve, said skirt forming a chamber in communication with said outlet passage, and said skirt terminating in the first valve seat, and said main valve comprising a disc having a sufficient radial dimension to open and close said first valve seat.

6. A device as defined in claim 1 in which said housing has an annular recess formed between said air inlet passage and said outlet passage, opening toward said main valve and terminating in said first valve seat, said air outlet passage communicating with said recess downstream of the first valve seat, and said main valve comprising a disc having a sufficient radial dimension to open and close said first valve seat.

7. A device as defined in claim 1 which also comprises, an orifice communicating with the diaphragm chamber and the inlet passage, and a filter associated with said orifice for filtering air admitted to said diaphragm chamber through said orifice.

8. A device as defined in claim 7 in which said filter is carried by said main valve for movement therewith.

9. A device as defined in claim 1 which also comprises a plug carried by the solenoid in generally opposed relation to the plunger, a compression spring received between the plug and the plunger, and the plug being generally axially movable relative to the solenoid for varying and adjusting the force applied by the spring to the plunger to yieldably urge the plunger toward the first valve.

10. A device as defined in claim 9 wherein said slide rod is connected to said plug for generally axial movement in unison with said plug.

11. A device as defined in claim 9 wherein the slide rod is connected to and supported by the plug in a cantilever fashion adjacent only one end of the slide rod.

12. A device as defined in claim 1 which also comprises a plug carried by the solenoid in spaced apart and generally opposed relation to the plunger, a first spring received between the plug and the plunger, said slide rod extending through and beyond the first valve, a second compression spring telescoped over the slide rod and yieldably urging the first valve toward the plunger, and the plug being axially movable relative to the solenoid to vary the force with which the first compression spring yieldably urges the plunger toward the first valve.

13. A device as defined in claim 12 wherein the slide rod is connected to the plug for axial movement in unison with the plug to vary both the force with which the first spring urges the plunger toward the first valve and the force with which the second spring urges the first valve toward the plunger.

14. A device as defined in claim 12 wherein the slide rod is connected to and supported by the plug in a cantilever fashion adjacent only one end of the slide rod.

15. A device as defined in claim 1 wherein the slide rod is supported in a cantilever fashion adjacent only one end of the slide rod.

16. An idle speed bypass air control device for bypassing air around an intake throttle valve of an engine comprising, a housing having a bypass air inlet passageway, a bypass air outlet passageway including a cylindrical bore passage with an open end defining an annular first valve seat arranged for controlling bypass air flow between said passageways, a solenoid carried by the housing having a stationary electric coil and a movable armature plunger, said plunger being slidably received in the housing for movement relative to said coil, a main valve assembly including a valve body received in said bore passage and movable with said main valve assembly relative to said plunger and said first valve seat for axial travel of said valve body both interiorly of said bore passage and exteriorly thereof into said bypass air inlet passageway, said valve body defining a predetermined flow controlling clearance with said bore passage as a function of axial travel of said valve body with said main assembly and relative to said first valve seat, said main valve assembly also including a flexible valve disc movable with said valve body in said bypass air inlet passageway and only exteriorly of said bore passage to a fully open position spaced away from said first valve seat, said disc being progressively engageable with said first valve seat to a fully closed condition therewith and progressively disengageable to partially open positions as said disc is progressively disengaged and spaced from said first valve seat, a diaphragm carried by the housing and having one face defining in part a chamber and an opposite face communicating with said bypass air inlet passageway, said diaphragm being operably connected with said valve body, a first pilot valve member carried by said main valve assembly for movement therewith and communicating with the diaphragm chamber and said bypass air outlet passageway, and a second pilot valve member carded by said plunger and movable therewith to a closed position in engagement with said first pilot valve member and to an open position disengaged and spaced from said first pilot valve member and operable such that when the engine is operating with the throttle valve in a closed position and a subatmospheric pressure is applied to said bypass air outlet passageway of said device, said main valve assembly is opened by said diaphragm as a function of and proportional to an electric signal applied to said coil of said solenoid.

17. A device as defined in claim 16 in which said main valve assembly comprises a diaphragm retainer having a radially extending disc portion disposed in said diaphragm chamber to contact said one face of said diaphragm, said retainer having a hub projection extending centrally through said diaphragm and said valve disc and into said valve body, said retainer hub and said valve body cooperating to define an internal suction passageway axially therethrough communicating said first pilot valve member with said bypass air outlet passage.

18. A device as defined in claim 17 in which said valve body has a central bore received axially on said retainer hub, said valve body also having a hub, and wherein said device further includes a slide rod extending centrally coaxially of and through said retainer hub, said valve disc and said valve body hub for supporting the same for conjoint movement axially of the housing, said rod and said hubs being constructed and arranged to define said internal suction passageway.

19. A device as defined in claim 18 in which a resilient means is operably supported on said rod in contact with said main valve assembly and operable to provide a biasing force for moving said main valve assembly to an open condition when the engine is shut off.

20. A device as defined in claim 19 wherein said resilient means comprises a coil spring sleeved on said rod and operably acting between said housing and said valve body for yieldably biasing said main valve assembly toward an open condition.

21. A device as defined in claim 19 wherein said resilient means comprises said valve disc.

22. A device as defined in claim 19 wherein said cylindrical bore passage comprises an annular skirt extending coaxially with said slide rod and from one end of said housing toward said main valve, said skirt forming a chamber in communication at one end thereof with said bypass air outlet passageway terminating at an axially opposite end in said first valve seat, said valve disc having a sufficient radial dimension to radially overlap said first valve seat for flexibly opening and closing the same.

23. A device as defined in claim 16 which also comprises a calibrated orifice passageway communicating with the diaphragm chamber and said bypass air inlet passageway, and a filter associated with said orifice passageway for filtering air admitted from said inlet passageway to the diaphragm chamber through said orifice passageway.

24. A device as defined in claim 23 in which said filter is carried by said main valve assembly for movement therewith adjacent said diaphragm and said orifice passageway extends through said diaphragm.

25. A device as defined in claim 16 which also comprises an adjustment plug carried by said housing in generally axially opposed relation to said plunger, a first compression spring received between said plug and said plunger, said plug being generally axially adjustable relative to said solenoid coil for varying and adjusting the force applied by said first spring to said plunger to yieldably urge said plunger toward said main valve assembly.

26. A device as defined in claim 25 further including a slide rod extending coaxially through and beyond both axially remote opposite ends of said diaphragm and said main valve assembly, a second compression spring telescoped over said slide rod and yieldably urging said main valve assembly toward said plunger, said second spring being operable to exert a greater biasing force than said first spring.

27. A device as defined in claim 26 wherein said slide rod is operably connected to said plug for axial adjustment movement in unison with said plug.

28. A device as defined in claim 26 wherein the slide rod is operably connected to said second spring to vary both the force with which said first spring urges said plunger toward said main valve assembly and the force with which the second spring urges said main valve assembly toward the plunger.

29. A device as defined in claim 25 wherein said slide rod is axially fixedly and supported in a cantilever fashion on said housing adjacent only one end of the slide rod and said plunger and said main valve assembly are slidably supported on and movable axially relative to said slide rod.

30. A device as defined in claim 29 wherein said slide rod is connected to and axially fixed and adjustably supported on said plug in a cantilever fashion adjacent said one end of said slide rod.

31. A device as defined in claim 30 wherein said solenoid, plunger and plug are mounted in a casing constructed separate from and attached in final assembly to said housing, and wherein said slide rod is connected to and cantilever supported by said plug and said plug is supported by said casing adjacent said one end of the slide rod, said rod also supporting in subassembly said main valve assembly thereon for final assembly insertion into said housing.

32. The device as defined in claim 16 wherein said valve body has a piston head with peripheral surface means cooperable with said air passage bore and said valve seat to vary the flow controlling cross sectional area of said air outlet side of said bypass air passageway as a function of the axial travel position of said valve body relative to said valve seat.

33. The device as set forth in claim 32 wherein said valve disc comprises a flexible member disposed adjacent said valve body piston head and cooperable therewith for peel-off opening action of said valve disc from closed seating on said valve seat.

34. The device as set forth in claim 33 wherein said valve disc comprises a thin flexible annular member made of resilient material and having a bowed form in its free state defining a concave side facing said valve seat, said valve disc being yieldably resilient to flexibly deform into fully closed engagement with said valve seat in the fully closed position of said main valve means, the resilience of said valve disc being operable to react against said valve seat to bias said valve disc to a partially open position relative to said valve seat when the engine is shut down to thereby condition said valve means for bypass air flow during cold-cranking of the engine.

35. The device as set forth in claim 32 wherein said air passage bore is a cylinder of constant inside diameter along the travel path of said valve body piston head therein, and wherein said peripheral surface of said valve body piston head has a cylindrical portion adjacent the upstream end of said piston head having a predetermined diametrical clearance with said air passage bore, and wherein said piston head peripheral surface also has a generally conical portion adjacent said cylindrical portion at the downstream end of said piston head with a convergent cone angle tapering in the downstream direction from the diameter of said cylindrical portion, said peripheral surface portions having a predetermined axial length correlated with axial travel increments of said valve means to thereby vary the rate of air flow past said valve seat in a predetermined manner as a function of valve means travel position as said piston head moves toward and past said valve seat in a valve-opening direction, and vice versa.

36. An idle speed bypass air control device for bypassing air around an intake throttle valve of an engine, comprising; a housing having a mounting surface, an air inlet and an air outlet each opening into the mounting surface and symmetrically located on the mounting surface so that in assembly the inlet is disposed upstream of said throttle valve and the outlet is disposed downstream of said throttle valve, an outlet passage adjacent to and communicating with the outlet and having an open end defining an annular first valve seat arranged for controlling bypass air flow between the inlet and outlet, a pair of mounting holes open to the mounting surface and symmetrically located on the mounting surface relative to the inlet and outlet allowing said housing to be rotated 180° to position the the outlet downstream of the throttle valve regardless of the direction of the intake air flow, a solenoid carried by the housing and having an electric coil and a movable plunger, an axially elongated slide rod disposed generally coaxially with the coil, the plunger being slidably received on the rod for movement relative to the rod and the coil, a main valve slidably received on the rod and movable relative to the plunger and the seat, the main valve being movable on the rod to a closed position engageable with the seat and to open positions disengaged and spaced from the seat, a diaphragm carried by the housing for actuating the main valve and with one face defining in part a chamber and the other surface communicating with the inlet, a second valve seat carried by the main valve for movement therewith and communicating with the diaphragm chamber and the outlet passage, and a pilot valve carried by the plunger and movable by the plunger to a closed position in engagement with the second seat and to an open position disengaged and spaced from the second seat, whereby when the engine is operating with the throttle valve in a closed position and a subatmospheric pressure is applied to the outlet passage of the device, the opening of the main valve by the diaphragm is a function of and proportional to an electric signal applied to the coil of the solenoid.

37. The device as defined in claim 36 wherein the housing has a cylindrical wall, disposed substantially coaxially with the outlet passage, that telescopically receives the outlet passage and is constructed to receive the diaphragm.

38. The device as defined in claim 37 wherein the cylindrical wall has an annular groove formed adjacent its upper edge constructed to receive and retain the outer edge of the diaphragm.

39. The device as defined in claim 37 which also comprises a flange adjacent the upper edge of the wall and the solenoid has a corresponding flange substantially coaxial with the coil of the solenoid, and each flange has a surface to facilitate securely connecting the solenoid to the housing.

40. The device as defined in claim 39 wherein each of the flanges is generally annular allowing the solenoid to be circumferentially rotated relative to the housing.

41. The device as defined in claim 36 wherein the axis of the solenoid is disposed generally perpendicular to the mounting surface of the housing.

42. The device as defined in claim 36 wherein the outlet, outlet passage, rod, and solenoid coil are all generally coaxial.

43. The device as defined in claim 42 wherein the axis of the outlet, outlet passage, rod and solenoid coil is generally perpendicular to the mounting surface.

44. A device as defined in claim 36 which also comprises a calibrated orifice passageway communicating with the chamber and said air inlet, and a filter associated with said orifice passageway for filtering air admitted from said inlet passageway to the diaphragm chamber through said orifice passageway.

45. A device as defined in claim 44 which said filter is carried by said main valve for movement therewith adjacent said diaphragm and said orifice passageway extends through said diaphragm.

46. A device as defined in claim 36 which also comprises an adjustment plug carried by said housing in generally axially opposed relation to said plunger, a first compression spring received between said plug and said plunger, said plug being generally axially adjustable relative to said solenoid coil for varying and adjusting the force applied by said first spring to said plunger to yieldably urge said plunger toward said main valve.

47. A device as defined in claim 46 wherein said slide rod is axially fixedly supported in a cantilever fashion on said housing adjacent only one end of the slide rod and said plunger and said main valve assembly are slidably supported on and movable axially relative to said slide rod.

48. A device as defined in claim 47 wherein said slide rod is connected to and axially fixed and adjustable supported on said plug in a cantilever fashion adjacent said one end of said slide rod.

49. An idle speed bypass air control device for bypassing air around an intake throttle valve of an engine, comprising; a housing having a mounting surface, an air inlet and an air outlet each opening into the mounting surface and symmetrically located on the mounting surface so that in assembly the inlet is disposed upstream of said throttle valve and the outlet is disposed downstream of said throttle valve, an outlet passage adjacent to and communicating with the outlet and having an open end defining an annular first valve seat arranged for controlling bypass air flow between the inlet and outlet, a pair of mounting holes open to the mounting surface and symmetrically located on the mounting surface relative to the inlet and outlet and allowing said housing to be rotated 180° to position the outlet downstream of the throttle valve regardless of the direction of the intake air flow, a solenoid carried by the housing generally perpendicular to the mounting surface and having an electric coil and a movable plunger, an axially elongate slide rod disposed generally coaxially with the coil, the plunger being slidably received on the rod for movement relative to the rod and the coil, a main valve slidably received on the rod and movable relative to the plunger and the seat, the main valve being movable on the rod to a closed position engageable with the seat and to open positions disengaged and spaced from the seat, a diaphragm carried by the housing for actuating the main valve and with one face defining in part a chamber and the other face communicating with the inlet passage, a second valve seat carried by the main valve for movement therewith and communicating with the diaphragm chamber and the outlet passage, and a pilot valve carried by the plunger and movable by the plunger to a closed position in engagement with the second seat and to an open position disengaged and spaced from the second seat, whereby when the engine is operating with the throttle valve in a closed position and a subatmospheric pressure is applied to the outlet passage of the device, the opening of the main valve by the diaphragm is a function of and proportional to an electric signal applied to the coil of the solenoid.

50. In an idle speed control device for an automotive engine of a type that includes an engine intake pipe and a bypass air passageway extending in bypassing relationship to a throttle valve in said intake pipe so that, when said throttle valve is in a substantially closed idle position, air flows through said bypass air passageway with a pressure thereof pulsated in accordance with the engine rotation, said device including a solenoid, a plunger movable by said solenoid, and a main valve means operative to control the rate of the air flow through said bypass air passageway in accordance with a displacement of said plunger, and wherein said main valve means has a valve stem means which is formed with a communication passage;

a casing for said device, said casing including a support formed on said casing, one end of said valve stem means being supported in said support, a diaphragm disposed on an air inlet side of said bypass air passageway and operably coupled to said main valve means, and a vacuum chamber defined between one side of said diaphragm and said casing enclosing said diaphragm, said vacuum chamber being supplied with vacuum from an air outlet side of said bypass air passageway through said communication passage in said valve stem means;

said vacuum chamber being provided with a vacuum leak passage formed between said vacuum chamber and said air inlet side of said bypass air passageway;

a first pilot valve closure member provided on an end of said plunger in opposite relationship to a second pilot valve closure member of said valve stem means to cooperate therewith to control the supply of vacuum into said vacuum chamber via said communication passage; and said pilot valve closure member being operable such that when said members are separated when said main valve means is moved in a valve-closing direction due to an increase in the vacuum in said intake pipe such members separation causes a greater engine intake vacuum to be communicated with said vacuum chamber than can be balanced by vacuum relief via the vacuum leak passage to thereby cause the diaphragm to move said main valve means in a valve-opening direction and thereby tending to re-close said pilot valve closure members;

the improvement in combination therewith of an air passage bore forming part of said air outlet side of said bypass air passageway and having an open end forming an annular main valve seat communicating with said air inlet side of said bypass air passageway, and said main valve means is axially movable relative to said main valve seat between fully open and fully closed positions therewith and comprises a valve disc and a valve body, said valve body being movable both axially within said bore and internally thereof through and axially past said main valve seat so as to protrude therefrom into said air inlet side of said bypass air passageway, said valve body being shaped relative to said air passage bore to controllably vary the rate of air flowing past said main valve seat and through said air passage bore as a function of incremental axial travel of said valve body relative to and past said main valve seat both while within and when protruding from said air passage bore, said valve disc being operably coupled to move with said valve body in upstream air flow relation thereto and being disposed in said air inlet side of said bypass air passageway, said valve disc being engageable with said valve seat for fully closing with the same with said valve body retracted in said air passage bore, said valve disc being disengageable from said valve seat in response to a predetermined increment of initial axial travel of said main valve means from the fully closed position thereof toward the open position of said main valve means.

51. The device as defined in claim 50 wherein said valve body has a piston head with peripheral surface means cooperable with said air passage bore and said valve seat to vary the flow controlling cross sectional area of said air outlet side of said bypass air passageway as a function of the axial travel position of said valve body relative to said valve seat.

52. The device as set forth in claim 51 wherein said valve disc comprises a flexible member disposed adjacent said valve body piston head and cooperable therewith for peel-off opening action of said valve disc from closed seating on said valve seat.

53. The device as set forth in claim 52 wherein said valve disc comprises a thin flexible annular member made of generally non-resilient material.

54. The device as set forth in claim 52 wherein said valve disc comprises a thin flexible annular member made of resilient material and having a bowed form in its free state defining a concave side facing said valve seat, said valve disc being yieldably resiliently to flexibly deform into fully closed engagement with said valve seat in the fully closed position of said main valve means, the resilience of said valve disc being operable to react against said valve seat to bias said valve disc to a partially open position relative to said valve seat when the engine is shut down to thereby condition said valve means for bypass air flow during cold-cranking of the engine.

55. The device as set forth in claim 52 wherein said valve body piston head has a wedge shaped face disposed adjacent said valve disc operable to produce a gradual peel-opening flexing action of said valve disc relative to said valve seat during initial opening axial travel of said valve means from said fully closed position thereof.

56. The device as set forth in claim 51 wherein said air passage bore is a cylinder of constant inside diameter along the travel path of said valve body piston head therein, and wherein said peripheral surface of said valve body piston head has a cylindrical portion adjacent the upstream end of said piston head having a predetermined diametrical clearance with said air passage bore, and wherein said piston head peripheral surface also has a generally conical portion adjacent said cylindrical portion at the downstream end of said piston head with a convergent cone angle tapering in the downstream direction from the diameter of said cylindrical portion, said peripheral surface portions having a predetermined axial length correlated with axial travel increments of said valve means to thereby vary the rate of air flow past said valve seat in a predetermined manner as a function of valve means travel position as said piston head moves toward and past said valve seat in a valve-opening direction, and vice versa.

57. The device as set forth in claim 50 wherein said plunger pilot valve first closure member comprises an end face of said plunger having a ring-like valve closure seat thereon, and said pilot valve second closure member comprises a diaphragm retainer disc having a flat face with a pilot valve opening therein communicating with said communication passage in said valve stem means, said plunger closure seat being oriented to close said retainer disc opening when said plunger face abuts said retainer disc face.

58. The device as set forth in claim 57 wherein said plunger end face has a planar surface encircling and flush with an end face of said ring-like valve closure seat, and wherein said plunger has an air bleed array of grooves formed in said planar surface leading from the outer periphery of the plunger to an annular groove in said planar surface encircling said ring-like closure seat adjacent thereto.

59. The device as set forth in claim 50 wherein said solenoid plunger comprises an outer sleeve in the form of a thin walled body made of ferromagnetic material and an inner core concentrically received in said outer sleeve and made of lightweight non-ferromagnetic material, said plunger pilot valve closure member being formed on an end face of said core facing said main valve means.

60. The device as set forth in claim 59 wherein said sleeve is made of stainless steel and said core is made of glass/mineral filled PPS.

61. The device as set forth in claim 50 wherein said valve stem means includes an axially elongated slide rod disposed generally coaxially with a coil of said solenoid, said plunger being slidably received on said rod for movement relative to said rod and coil, said main valve means being slidably received on said rod and movable relative to said plunger and said main valve seat to a closed position with said main valve disc engageable with said main valve seat and to open positions with said valve disc disengaged and spaced from said seat, said second pilot valve closure member comprising a pilot valve opening carried by said main valve means for movement therewith and communicating with the diaphragm chamber and the air outlet side of said bypass air passage.

62. The device as defined in claim 61 in which said main valve means comprises a diaphragm retainer disc having a radially extending portion contacting said one side of said diaphragm and having an axially extending hollow hub projecting centrally of said disc and containing an internal passageway and a bearing wall surface slidably contacting said slide rod, said retainer hub carrying said valve disc and valve body thereon and having at least one axial slot through said bearing surface contacting said slide rod, said retainer disc having said pilot valve opening therein communicating via said hub internal passageway with the air outlet side of said bypass air passage.

63. The device as defined in claim 62 in which said main valve body has a hollow hub encircling said slide rod and a bearing wall surface slidably engaging said slide rod, said valve body hub bearing wall surface having at least one axial passage therethrough communicating with said axial slot of said retainer disc hub.

64. The device as defined in claim 62 wherein said leak passage comprises a calibrated orifice in said retainer disc communicating via openings in said diaphragm with the inlet side of said bypass air passage, and further including an annular air filter associated with said orifice for filtering air admitted to said diaphragm chamber through said orifice, said filter comprising an annulus carried on said retainer disc hub projection axially between said diaphragm and said valve disc and covering said diaphragm openings.

65. The device as defined in claim 50 which also comprises an adjustment plug carried by the solenoid in generally opposed relation to said plunger, a first compression spring received between said plug and said plunger, said plug being generally axially adjustable relative to said solenoid for varying and adjusting the force applied by said first spring to said plunger to yieldably urge said plunger toward said main valve means.

66. The device as defined in claim 65 and further including a slide rod extending through and beyond said main valve body for supporting the same for movement relative to the main valve seat and also including a second compression spring telescoped over said slide rod and yieldably urging said main valve body toward said plunger, said slide rod being operably connected to said plug to adjustably vary both the force with which said first spring urges said plunger toward said main valve means and the force with which said second spring urges said main valve means toward said plunger.

67. The device as defined in claim 66 wherein said slide rod is connected to and supported by said plug in a cantilever fashion adjacent only one end of the slide rod, said main valve body hub being slidably received on said rod and having radially protruding guide fins slidably bearing on the internal surface of said air passage bore for centering and stabilizing said main valve means during sliding travel along a portion of said slide rod disposed remote from said one of said slide rod.

* * * * *

UNITED STATES PATENT AND TRADEMARK OFFICE

CERTIFICATE OF CORRECTION

PATENT NO. : 5,722,367

DATED : March 3, 1998

INVENTOR(S) : Randall P. Izydorek/Charles H. Tuckey/Kevin L. Williams

It is certified that error appears in the above-indentified patent and that said Letters Patent is hereby corrected as shown below:

On cover sheet of patent, in the title, change "Ingine" to "ENGINE".

Col 1, Line 1, change "INGINE" to "ENGINE".

Col 21, Line 67, change "carded" to "carried".

Col 25, Line 10, change "which" to "wherein".

Col 25, Line 28, change "adjustble" to "adjustably".

Signed and Sealed this

FourthDay of August, 1998

Bruce Lehman

*Attest:*

BRUCE LEHMAN

*Attesting Officer*

*Commissioner of Patents and Trademarks*